US007047922B2

(12) United States Patent
Asada et al.

(10) Patent No.: US 7,047,922 B2
(45) Date of Patent: May 23, 2006

(54) VALVE-DRIVING SYSTEM OF INTERNAL COMBUSTION ENGINE AND VALVE-DRIVING APPARATUS

(75) Inventors: Toshiaki Asada, Mishima (JP); Shuichi Ezaki, Susono (JP); Kimitoshi Tsuji, Susono (JP); Yasushi Kusaka, Susono (JP); Kenji Kataoka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 74 days.

(21) Appl. No.: 10/725,444

(22) Filed: Dec. 3, 2003

(65) Prior Publication Data

US 2004/0107928 A1 Jun. 10, 2004

(30) Foreign Application Priority Data

Dec. 5, 2002 (JP) ..... 2002-354235

(51) Int. Cl.
*F01L 1/34* (2006.01)

(52) U.S. Cl. ..... 123/90.16; 123/90.11; 123/90.15

(58) Field of Classification Search ..... 123/90.16, 123/90.11, 90.6, 90.31, 90.15, 90.17
See application file for complete search history.

(56) References Cited

U.S. PATENT DOCUMENTS 4,957,074 A 9/1990 Weissler, II et al.
5,016,583 A * 5/1991 Blish ..... 123/190.7
5,220,904 A * 6/1993 Miyashita et al. ..... 123/680
5,331,931 A 7/1994 Blish et al.
5,494,007 A * 2/1996 Schroeder et al. ..... 123/90.11
5,598,814 A 2/1997 Schroeder et al.
5,873,335 A * 2/1999 Wright et al. ..... 123/90.11
5,931,142 A 8/1999 Gerling
5,983,847 A 11/1999 Miyoshi et al.
5,988,123 A 11/1999 Miyoshi et al.
6,371,065 B1 * 4/2002 Shiraishi et al. ..... 123/90.15
6,401,684 B1 * 6/2002 Hori et al. ..... 123/198 F
6,663,524 B1 * 12/2003 Gu et al. ..... 475/5

FOREIGN PATENT DOCUMENTS

FR 2 823 529 A1 10/2002
JP A 08-177536 7/1996
JP A 2001-152820 6/2001

* cited by examiner

*Primary Examiner*—Thomas Denion
*Assistant Examiner*—Zelalem Eshete
(74) *Attorney, Agent, or Firm*—Oliff & Berridge, PLC

(57) ABSTRACT

A valve-driving system, which is applied to an internal combustion engine having a plurality of cylinders, for driving an intake or exhaust valve provided in each cylinder, comprising: a plurality of valve-driving apparatuses, each of which is provided for at least each one of the intake valve and the exhaust valve, each valve-driving apparatus having an electrical motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with the operation state of the internal combustion engine.

17 Claims, 18 Drawing Sheets

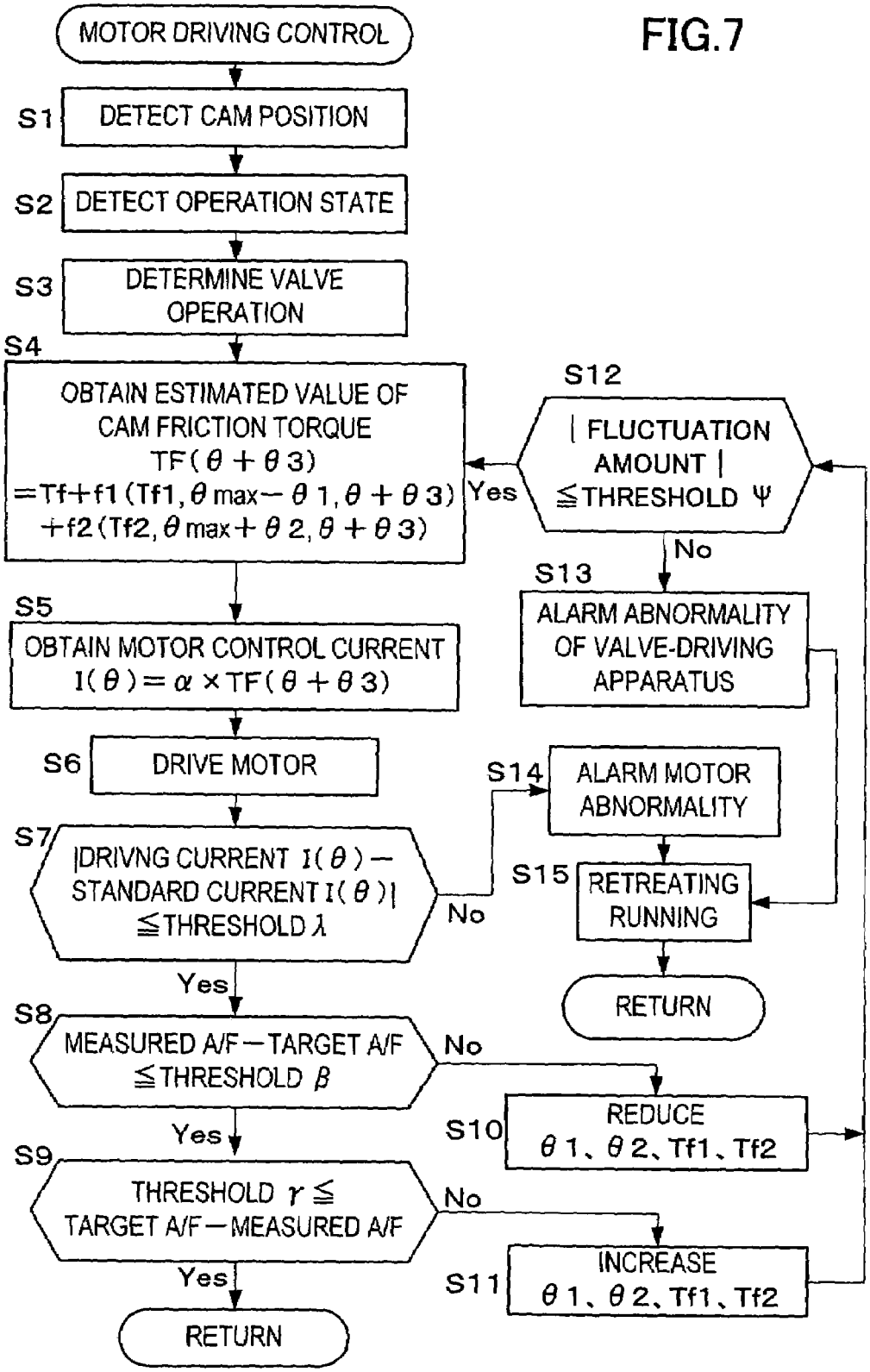
FIG.7
MOTOR DRIVING CONTROL
S1
DETECT CAM POSITION
S2
DETECT OPERATION STATE
S3
DETERMINE VALVE OPERATION
S4
OBTAIN ESTIMATED VALUE OF CAM FRICTION TORQUE TF(θ+θ3) =Tf+f1(Tf1, θmax−θ1, θ+θ3) +f2(Tf2, θmax+θ2, θ+θ3)
S5
OBTAIN MOTOR CONTROL CURRENT I(θ)=α×TF(θ+θ3)
S6
DRIVE MOTOR
S7
|DRIVNG CURRENT I(θ)− STANDARD CURRENT I(θ)| ≦THRESHOLD λ
No
Yes
S8
MEASURED A/F−TARGET A/F ≦THRESHOLD β
No
Yes
S9
THRESHOLD γ≦ TARGET A/F−MEASURED A/F
No
Yes
RETURN
S12
| FLUCTUATION AMOUNT | ≦THRESHOLD Ψ
Yes
No
S13
ALARM ABNORMALITY OF VALVE-DRIVING APPARATUS
S14
ALARM MOTOR ABNORMALITY
S15
RETREATING RUNNING
RETURN
S10
REDUCE θ1、θ2、Tf1、Tf2
S11
INCREASE θ1、θ2、Tf1、Tf2

VALVE-DRIVING SYSTEM OF INTERNAL COMBUSTION ENGINE AND VALVE-DRIVING APPARATUS

BACKGROUND OF THE INVENTION

1. Field of the Invention

The present invention relates to a valve-driving system for driving intake or exhaust valves of an internal combustion engine, and also to a valve-driving apparatus which constitutes the valve-driving system.

2. Description of the Related Art

An intake valve or an exhaust valve of a conventional internal combustion engine is opened and closed by power taken out from a crank shaft of an internal combustion engine. In recent years, however, an attempt has been made to drive the intake valve or the exhaust valve by means of an electric motor. For example, Japanese Patent Application Laid-open No. 8-177536 discloses a valve-driving apparatus which drives a cam shaft by a motor to open and close the intake valve, and for driving an EGR valve, there is also known a valve-driving apparatus which converts rotation of a motor into a straight opening and closing motion of the valve utilizing a screw mechanism provided on a valve stem (see JP-A No. 10-73178).

Since the apparatus which converts rotation of a motor into opening and closing motion of a valve by means of the screw mechanism is such that a necessary amount of rotation of the motor is great, thus being inefficient, it is not suitable as a driving apparatus of an intake valve or an exhaust valve which requires to operate the valve at high speed and periodically.

On the other hand, when the cam shaft is rotated by a motor, it is possible to drive the intake valve or the exhaust valve efficiently. In an internal combustion engine which has a plurality of cylinders and is generally used as a power source of a vehicle, a cam shaft is commonly used between a plurality of cylinders arranged in a single line. If the commonly used cam shaft is only driven by the motor, the variation of motion of the cam shaft affects operation characteristics of all of the intake valves and exhaust valves which are driven by the cam shaft. Therefore, flexibility of operation characteristics which are obtained by controlling the motor is not so high.

SUMMARY OF THE INVENTION

It is an object of the present invention to provide a valve-driving system which is applied to an internal combustion engine having a plurality of cylinders and which is capable of efficiently opening and closing intake valves or exhaust valves thereof, and capable of enhancing the flexibility concerning the operation characteristics of each valve as compared with the conventional technique. It is another object of the invention to provide a valve-driving apparatus used for the valve-driving system.

To achieve the object, the present invention provides a valve-driving system which is applied to an internal combustion engine having a plurality of cylinders for driving an intake or exhaust valve provided in each cylinder, comprising: a plurality of valve-driving apparatuses, each of which is provided for at least each one of the intake valve and the exhaust valve, each valve-driving apparatus comprising an electrical motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with the operation state of the internal combustion engine.

According to this valve-driving system of the invention, since a plurality of valve-driving apparatuses are provided, it is possible to provide appropriate operation characteristics which are suitable for operation state of the internal combustion engine with respect to the intake valves or exhaust valves of the plurality of cylinders. In the valve-driving system of the invention, the valve-driving apparatuses may drive at least each one of the intake valve or the exhaust valve of different cylinders. Therefore, the valve-driving apparatus may be provided for each cylinder independently, or the valve-driving apparatus may be provided for the intake valve and the exhaust valve of each cylinder independently. A part of, or all of the valve-driving apparatuses may drive the intake valves or exhaust valves of the two or more different cylinders. In cylinders in which time periods during which the intake valves are opened or exhaust valves are opened are not overlapped, even if the intake valves or exhaust valves of these cylinders are driven by a common electric motor, the operation characteristics of the intake valve or exhaust valve of each cylinder can be changed without being influenced by operation of the intake valve or exhaust valve driven by the commonly used electric motor.

In the valve-driving system of the invention, the motor control device may control the operation of the electric motor in accordance with the operation state of the internal combustion engine such as to change operation characteristics of at least one of an operation angle, lift characteristics and a maximum lift amount of the valve to be driven. In this case, it is possible to more flexibly change the operation of the intake valve or exhaust valve as compared with the conventional valve-driving apparatus in which only the opening and closing timing is changed. If the rotation speed of the electric motor while the intake valve or exhaust valve is opened is increased or reduced, the operation angle is changed, and if the rotation speed, i.e., the acceleration is changed, the lift characteristics are changed. The lift characteristics are grasped as characteristics concerning a corresponding relation between the lift amount and the crank angle of the intake valve or exhaust valve. Concerning the lift amount, it is possible to limit the lift amount of the intake valve or exhaust valve to a value smaller than the maximum lift amount by controlling such that the rotation direction of the cam is switched to reversely rotate the cam at a stage earlier than a stage in which the lift position reaches the maximum lift position where the lift amount of the intake valve or exhaust valve becomes the maximum.

In the valve-driving system of the invention, the converting section of the power transmission mechanism can convert the rotation motion generated by the electric motor into the opening and closing motion of the intake valve or exhaust valve using a cam or a link. If the rotation motion is converted into the opening and closing motion of the intake valve or exhaust valve through the cam or link, a ratio of momentum of the valve to the rotation amount of the motor can be increased as compared with a case in which a screw mechanism is utilized. That is, in the case of the screw mechanism, the valve cannot be opened and closed sufficiently without rotating the screw several times at least, but if the cam or link is utilized, since one period of momentum is completed by one rotation output from the transmitting section, it is possible to open and close the intake valve or exhaust valve by a predetermined amount only by rotating the motor so that one rotation is input to the converting section. Thus, it is possible to efficiently drive the intake valve or exhaust valve.

The valve-driving system which converts the rotation generated by the electric motor into the opening and closing motion of the intake valve or exhaust valve by means of the cam can include the following modes.

The motor control device may set a control amount of the electric motor while taking, into account, the variation of friction torque which acts on rotation of the cam. When the operation of the electric motor is controlled without taking the cam friction torque into account, the rotation speed of the motor is varied from the target value of control due to influence of the cam friction torque. Therefore, the operation characteristics of the intake valve or exhaust valve are deviated from the control target and the operation state of the internal combustion engine is affected. For example, there is an adverse possibility that the fuel consumption, performance, exhaust emission or the like may be deteriorated. The control of the electric motor may become unstable. These inconveniences can be solved by adjusting the control amount of the electric motor while taking the cam friction torque into account. The friction torque in this invention means a rotation resistance applied to the driving source of the cam based on a mechanical structure from the electric motor to the intake valve or exhaust valve. A friction force generated in the mechanism from the driving source to the intake valve or exhaust valve increases the friction torque in the normal direction. A repulsion force of the spring device (valve spring) which pushes and returns the intake valve and exhaust valve in their closing directions increases the friction torque in a negative direction. When the electric motor is controlled, it is necessary to output a torque required for rotating the cam against the friction torque, and the control of the electric motor is realized by increasing or reducing the control variable (parameter) associated with the output torque of the electric motor. The setting and adjustment of the control amount of the electric motor of this invention means setting and adjustment of such a control variable.

The motor control device may set the control amount of the electric motor while taking, into account, a control state concerning intake or exhaust characteristics of the internal combustion engine. If the operation of the intake valve or exhaust valve is deviated from the control target, intake characteristics or exhaust characteristics of the internal combustion engine cannot be controlled in accordance with the target, and the fuel consumption, performance, exhaust emission or the like may be deteriorated. When the control state concerning the intake or exhaust characteristics is taken into account and the control state is deviated from the target, such inconvenience can be solved by adjusting the control amount of the electric motor such that the deviation is reduced.

As the intake or exhaust characteristics, various states which are in association with operation characteristics of the intake valve or exhaust valve may be taken into account. For example, an intake air amount in the cylinder, a pressure in the cylinder, an internal EGR amount, the exhaust gas temperature, an air fuel ratio and the like may be taken into account as intake or exhaust characteristics. When the control state of the air fuel ratio is taken into account, it is desirable that the motor control device corrects the control amount of the motor such that the air fuel ratio is controlled to a predetermined target value. If such control is carried out, the deviation of the air fuel ratio can be cancelled by correcting the operation characteristics of the intake valve or exhaust valve, and it is possible to enhance the fuel consumption, to increase the output, and to improve the exhaust emission.

The valve-driving system may further comprise an abnormality judging device which judges whether the valve-driving system is abnormal based on a correction amount with respect to the control amount of the electric motor. The correction amount is provided by the consideration of the control state concerning intake or exhaust characteristics of the internal combustion engine. When there is an abnormal condition in the valve-driving system, an absolute value of the control amount of the electric motor becomes excessively large or small, or a change amount of the control amount becomes excessive. Hence, if the correction amount concerning the control amount of the electric motor is monitored, it is possible to judge whether the valve-driving system is abnormal without using an abnormality detecting sensor.

The motor control device may estimate variation of the number of revolution of the internal combustion engine based on variation in the operation state of the internal combustion engine, and may set a control amount of the electric motor while taking the result of the estimation into account. In this case, when the revolution number of the internal combustion engine is rapidly varied, if the control amount of the electric motor is increased or reduced while taking the variation into account, the response of the rotation speed of the cam with respect to the variation in the revolution number of the internal combustion engine can be quickened.

When a friction torque acting on the rotation of the cam assumes a negative value, the electric motor may be capable of being driven by rotation motion of the cam to generate electricity. In this case, the efficiency of the valve-driving system can be enhanced, capacity of battery required for driving the cam can be reduced, and the electricity-generating ability of an alternator mounted in the vehicle as a power generator can be set smaller.

A motor rotation position detecting device which detects a rotation position of the electric motor may be added to the electric motor, and the motor control device may include a cam position specifying device which specifies a rotation position of the cam based on the result of detection of the rotation position of the electric motor. By estimating the cam position from the rotation position of the motor, it becomes unnecessary to separately provide a sensor for detecting the cam position.

It is desirable that when a speed reducing ratio between the electric motor and the cam is defined as N:M (wherein, N>M, and N and M are integers having no common divisors except 1), N is set to 6 or lower. In this case, it is easy to detect the initial position of the cam, and the detection error can be suppressed.

The motor control device may include an initializing device which makes the electric motor rotate in accordance with a predetermined condition when the internal combustion engine is in a predetermined state, and which grasps a rotation position of the cam based on variation in driving state of the electric motor which appears in connection with variation in friction torque of the cam while rotating. Generally, the friction torque is reversed in the vicinity of the cam position where the lift amount of the intake valve or exhaust valve assumes the maximum value. On the other hand, the friction torque affects the driving state of the electric motor. For example, if the output torque of the electric motor is maintained at a constant value, the rotation speed of the motor is decreased as the friction torque is increased, and the rotation speed of the motor is increased as the friction torque is reduced. If the rotation speed of the electric motor is maintained at a constant value, the output torque of the motor is increased as the friction torque is increased, and the output torque of the motor is reduced as the friction torque is reduced. If such correlations are utilized, the cam position can be specified only by monitoring the driving state of the motor. The variation of the revolution number when the intake valve or exhaust valve starts opening or completes closing or the variation of the output torque of the electric motor assumes a predetermined state. The cam position may be specified when such variation is generated. In this case, driving electric power required for specifying the cam position can be reduced. When this is carried out when the internal combustion engine is stopped, it is possible to avoid the interference between the piston and the intake valve or exhaust valve.

The initializing device may rotate the electric motor when the internal combustion engine is stopped to grasp the rotation position of the cam, and may make a storing device, which can store information also during a stop time period of the internal combustion engine, store therein information indicative of the grasped rotation position of the cam. The motor control device may specify the rotation position of the cam based on the information stored in the storing device when the internal combustion engine is started next time, and may start controlling the electric motor. In this case, it is unnecessary to carry out the processing by means of the initializing device to grasp the rotation position of the cam when the internal combustion engine is started. Therefore, it is possible to swiftly start the internal combustion engine.

The motor control device may include a valve rotation executing device which drives the electric motor such that the valve rotates around its axial direction in a predetermined time period during stoppage of the internal combustion engine. In this case, it is possible to scrape off carbon adhered to a valve or a seat (valve seat) by rotating the valve. A contact position of the valve with a driving member such as a rocker arm can be moved around an axis of the valve to prevent deviated wear of the valve.

The motor control device may include a lift amount control device which normally and reversely drives the electric motor such that the lift amount of the valve is limited to a predetermined value which is smaller than a maximum lift amount which can be obtained when the cam is rotated through one revolution. In this case, if the cam is rotated normally and reversely, the lift amount can be limited to a value smaller than the maximum lift amount which can be applied to the intake valve or exhaust valve by the cam to open and close the intake valve or exhaust valve. Thus, even if the cam is designed suitably for the intake air amount at the time of high rotation and under high load, the cam can withstand an operation state of low rotation and under low load in which small intake air amount is sufficient. A rotation angle when the cam is rotated normally and reversely may be increased or reduced in accordance with the lift amount to be applied to the intake valve or exhaust valve.

The motor control device may include a mode switching device which switches driving modes of the electric motor between a normal rotation mode in which the electric motor is driven only in the normal direction and a normal-reverse rotation mode in which the electric motor is normally or reversely rotated in accordance with the operation state of the internal combustion engine. In this case, the driving states of the cam can appropriately be selected. For example, the cam may be rotated normally and reversely to limit the lift amount at the time of low rotation under low load, and the cam may be rotated normally at the time of high rotation under high load to rotate the cam at high speed with low torque by inertia of the cam shaft or the like.

A valve-driving apparatus of the present invention comprises: an electric motor as a driving source for generating rotation motion; a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operation of the electric motor such that operation characteristics of at least one of an operation angle, a lift characteristics and a maximum lift amount of the valve to be driven is changed in accordance with the operation state of the internal combustion engine. With this structure, the above problem can be solved. According to such a valve-driving apparatus, it is possible to change at least one of the operation angle, lift characteristics and the maximum lift amount of the intake valve or exhaust valve by controlling the operation of the electric motor. Therefore, it is possible to more flexibly change the operation of the intake valve or exhaust valve as compared with the conventional valve-driving apparatus in which only the opening and closing timing is changed. The valve-driving apparatus of the invention can include various preferred modes of the valve-driving system utilizing the above-described cam.

BRIEF DESCRIPTION OF THE DRAWINGS

FIG. 7 is a flowchart showing procedure of a motor driving control routine which is executed by a control apparatus shown in FIG. 2.

FIG. 23A shows a case in which the cleaning operation has been controlled, and FIG. 23B shows a case in which the cleaning operation has not been controlled.

DESCRIPTION OF THE PREFERRED EMBODIMENTS

[First Embodiment]

Figure 1:
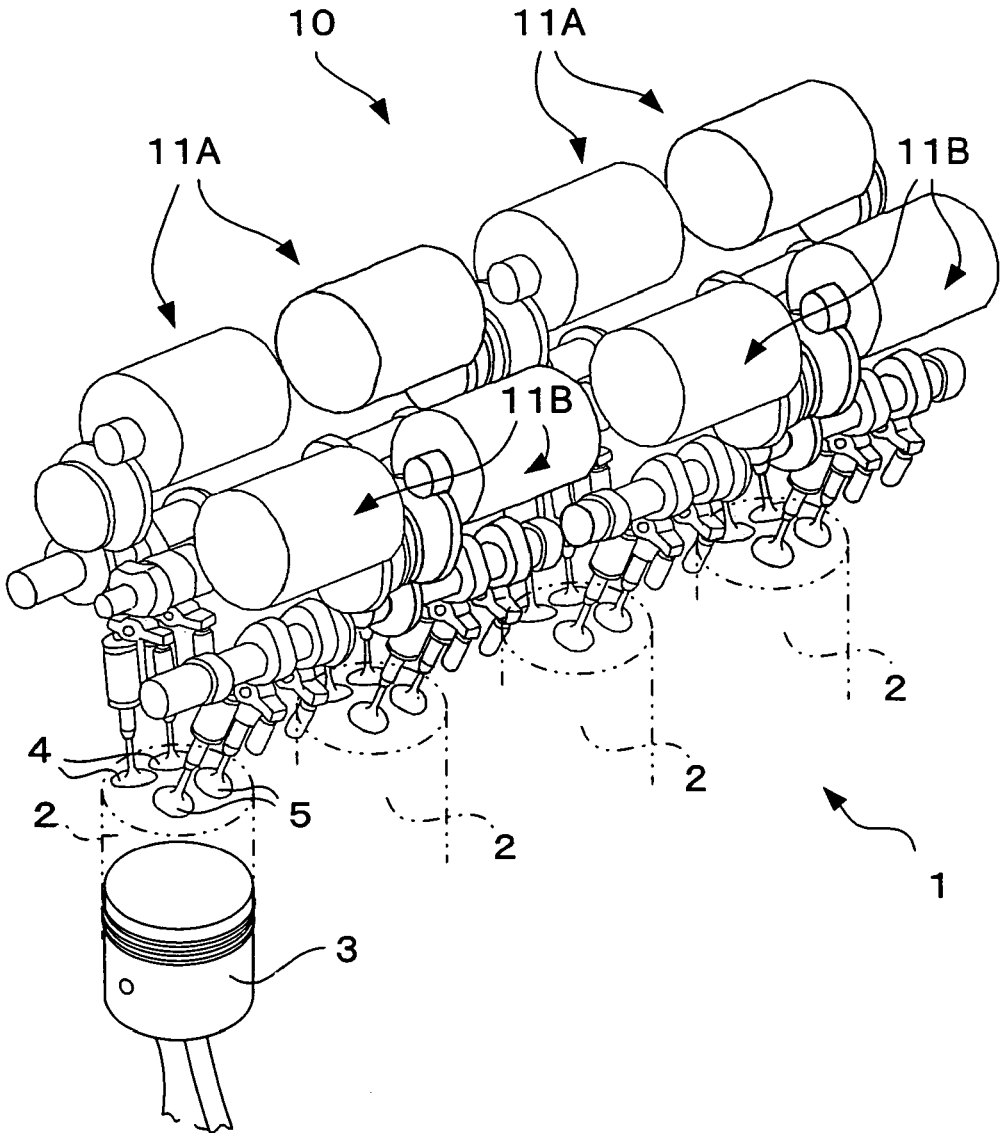
FIG. 1 is a perspective view showing a major portion of a valve-driving system according to a first embodiment of the present invention.

FIG. 1 shows an internal combustion engine 1 in which a valve-driving system according to the first embodiment of the present invention is incorporated. The internal combustion engine 1 is a multi-cylinder in-line gasoline engine. In the engine, a plurality of (four in FIG. 1) cylinders 2 . . . 2 are arranged in one direction, and pistons 3 are mounted in the respective cylinders 2 such that the pistons 3 can move vertically. Two intake valves 4 and two exhaust valves 5 are provided above each cylinder 2. These intake valves 4 and exhaust valves 5 are opened and closed by a valve-driving system 10 in association with vertical motion of the piston 3, thereby drawing air into the cylinder 2 and exhausting air from the cylinder 2.

Figure 2:
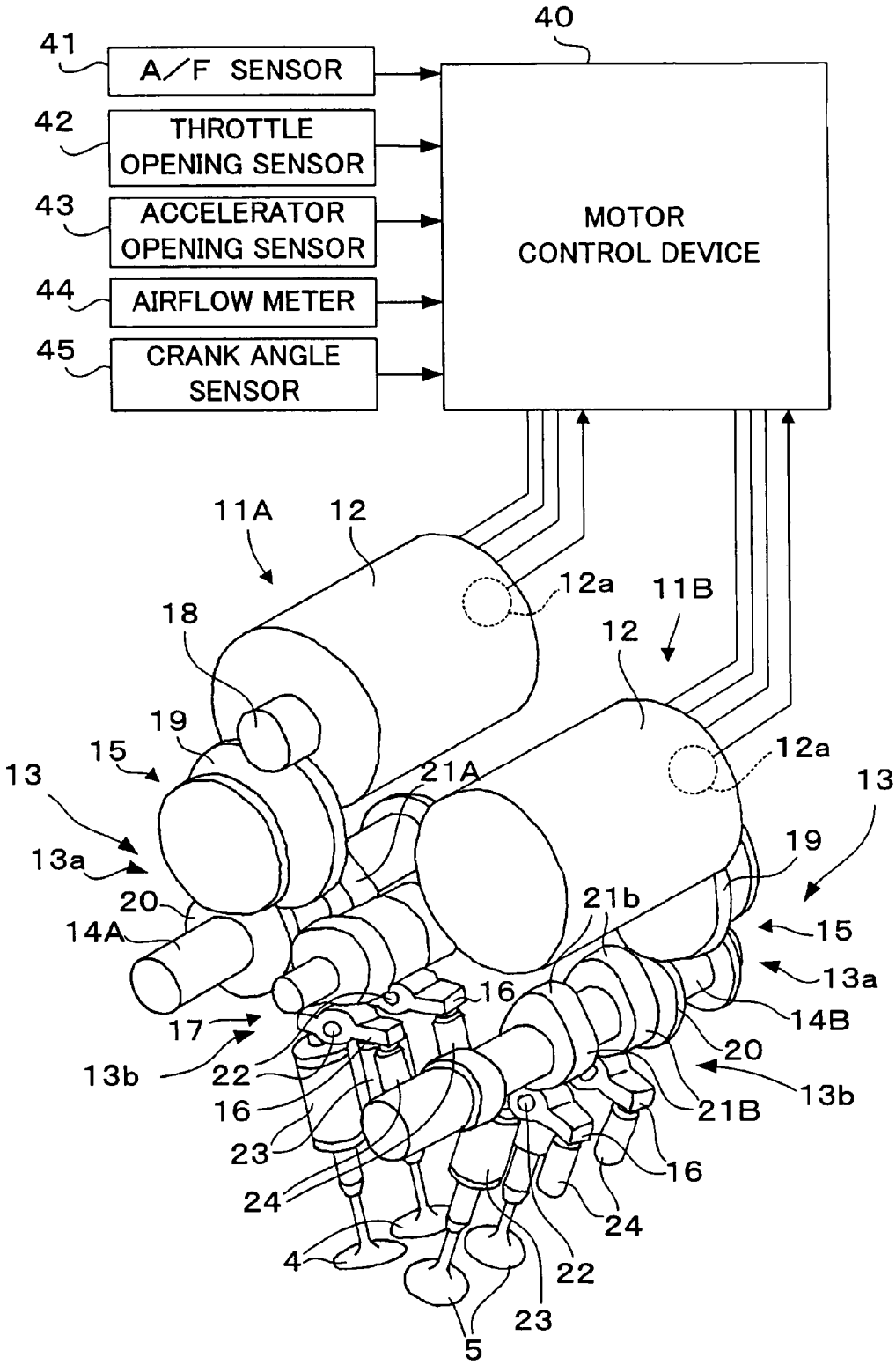
FIG. 2 is a perspective view showing a structure of a valve-driving apparatus which is correspondingly provided in one cylinder.

The valve-driving system 10 includes valve-driving apparatuses 11A . . . 11A provided on an intake-side of each cylinder 2 one each, and valve-driving apparatuses 11B . . . 11B provided on an exhaust-side of each cylinder 2 one each. The valve-driving apparatuses 11A and 11B drive the intake valve 4 or the exhaust valve 5 utilizing a cam. The valve-driving apparatuses 11A . . . 11A have the same structures and the valve-driving apparatuses 11B . . . 11B also have the same structures. FIG. 2 shows intake and exhaust valve-driving apparatuses 11A and 11B which are correspondingly provided in each cylinder 2. Since the valve-driving apparatuses 11A and 11B have similar structures, the intake-side valve-driving apparatus 11A will first be explained.

The intake-side valve-driving apparatus 11A includes an electric motor (which is called a motor hereinafter in some cases) 12 as a driving source, and a power transmission mechanism 13 which converts rotation motion of the motor 12 into a straight opening and closing motion. A DC brushless motor or the like which can control the rotation speed is used as the motor 12. A rotation position detecting device 12*a* such as a resolver, a rotary encoder or the like which detects a rotation position of the motor 12 is incorporated in the motor 12.

The power transmission mechanism 13 includes a single cam shaft 14A, a gear train 15 which transmits rotation motion of the motor 12 to the cam shaft 14A, a rocker arm 16 which drives the intake valve 4, and a valve-characteristics adjusting mechanism 17 interposed between the cam shaft 14A and the rocker arm 16. The cam shaft 14A is independently provided for each cylinder 2. That is, the cam shaft 14A is branched off for each cylinder 2. The gear train 15 transmits, through an intermediate gear 19, the rotation of the motor gear 18 mounted to an output shaft (not shown) of the motor 12 to a cam-driving gear 20 which is integrated with the cam shaft 14A, thereby rotating the cam shaft 14A in synchronization with the motor 12. Therefore, the gear train 15 including the gears 18, 19 and 20 serves as the transmitting section 13*a* of the power transmission mechanism 13. The gear train 15 may transmit the rotation motion at constant speed from the motor 12 to the cam shaft 14A or may change (reduce or increase) the rotation speed while transmitting the rotation motion.

Figure 3:
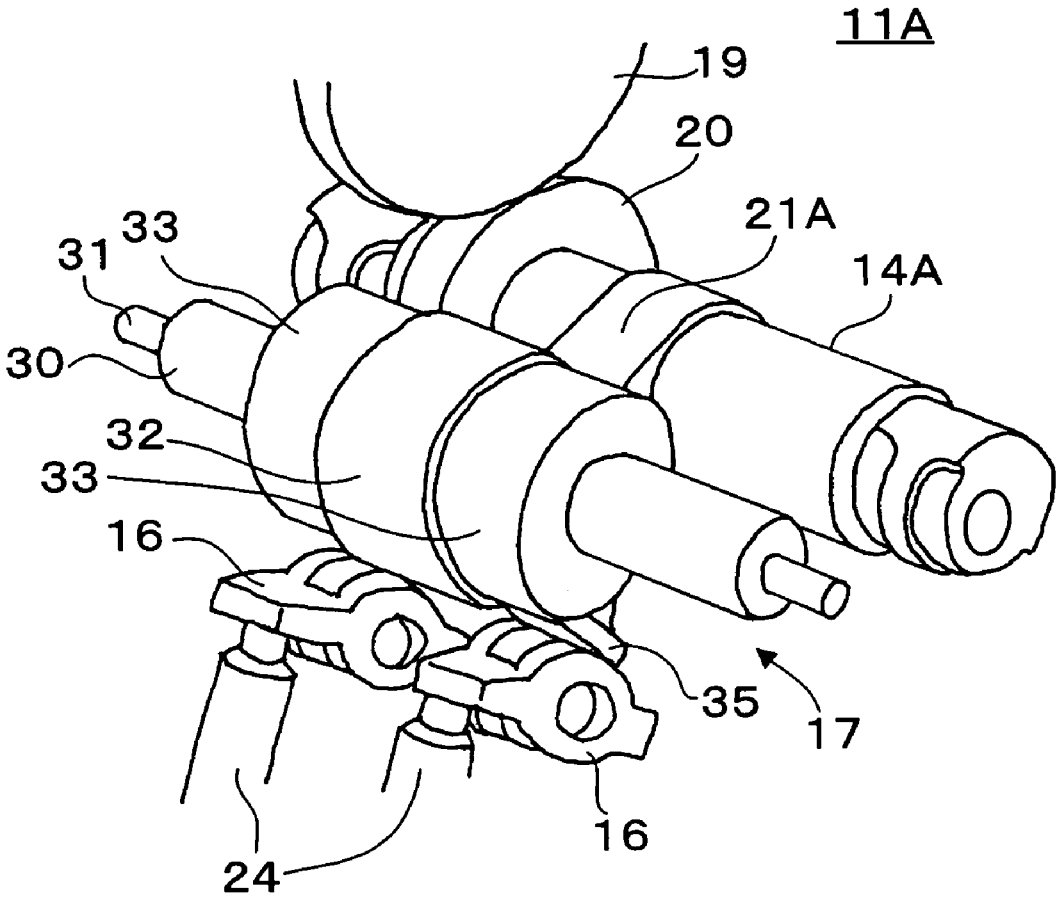
FIG. 3 is a perspective view of the valve-driving apparatus as viewed from another direction.
Figure 4:
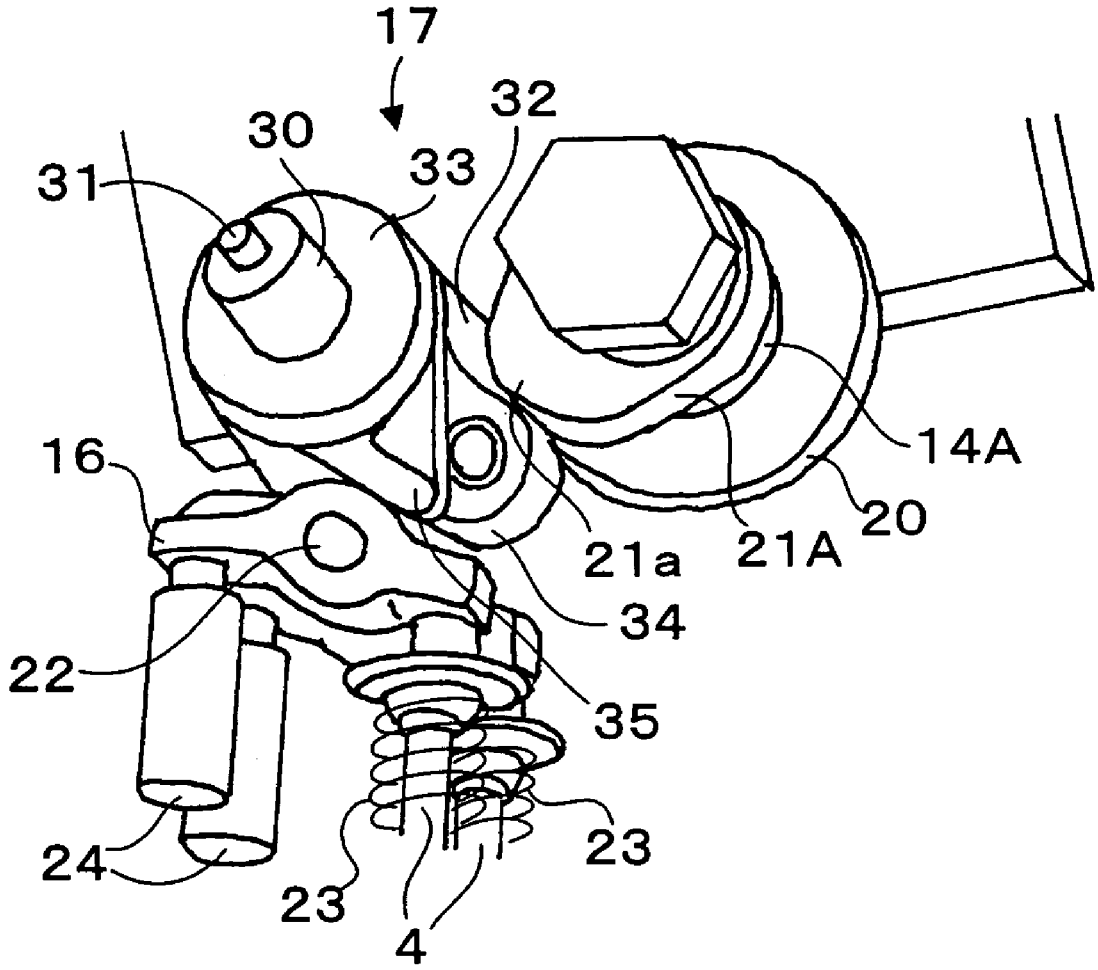
FIG. 4 is a perspective view of the valve-driving apparatus as viewed from further another direction.

As shown in FIGS. 3 and 4 also, the camshaft 14A is rotatably provided with a single cam 21A. The cam 21A is formed as one kind of a plate cam in which a portion of a base circle which is coaxial with the cam shaft 14A swells. The profiles (contour of outer periphery) of the cams 21A between all of the valve-driving apparatuses 11A are the same. The profile of the cam 21A is set such that a negative curvature is not generated along the entire periphery of the cam 21A, i.e., such that the profile draws a projecting curved surface radially outward.

The rocker arm 16 can swing around a spindle 22. The intake valve 4 is biased toward the rocker arm 16 by the valve spring 23, which brings the intake valve 4 into intimate contact with a valve seat (not shown) of an intake port to close the intake port. The other end of the rocker arm 16 is in contact with an adjuster 24. If the adjuster 24 pushes up the other end of the rocker arm 16, the one end of the rocker arm 16 is held contacted with an upper end of the intake valve 4. Therefore, the parts existing from the cam shaft 14A (or 14B) to the rocker arm 16 converts the rotation motion generated by the motor 12 into the opening and closing motion of the intake valve 4 (or the exhaust valve 5), thereby serving as a converting section 13*b* of the power transmission mechanism 13.

The valve-characteristics adjusting mechanism 17 functions as an intermediacy device which transmits the rotation motion of the cam 21A as swinging motion to the rocker arm 16, and also functions as a lift amount and operation angle changing device which changes the lift amount and the operation angle of the intake valve 4 by changing a correlation between the rotation motion of the cam 21A and the swinging motion of the rocker arm 16.

Figure 5:
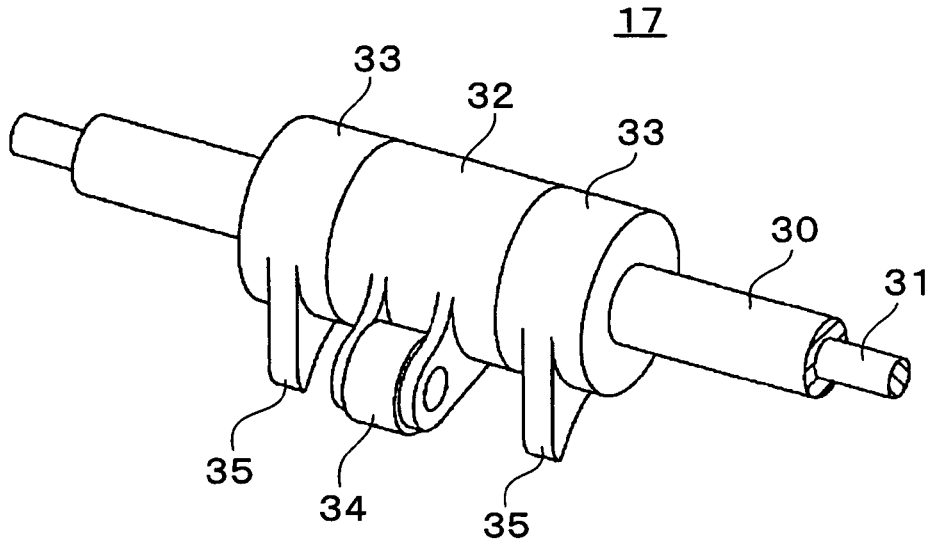
FIG. 5 is a perspective view of a valve-characteristics adjusting mechanism.

As shown in FIG. 5, the valve-characteristics adjusting mechanism 17 includes a supporting shaft 30, an operation shaft 31 which passes through a center of the supporting shaft 30, a first ring 32 disposed on the supporting shaft 30, and two second rings 33 and 33 disposed on opposite sides of the first ring 32. The supporting shaft 30 is fixed to a cylinder head or the like of the internal combustion engine 1. The operation shaft 31 is reciprocated in an axial direction (in directions R and F in FIG. 6) of the supporting shaft 30 by an actuator (not shown). The first ring 32 and second rings 33 are supported such that they can swing around the supporting shaft 30 and slide in the axial direction thereof.

A roller follower 34 is rotatably mounted on an outer periphery of the first ring 32, and noses 35 are respectively formed on outer peripheries of the second rings 33.

Figure 6:
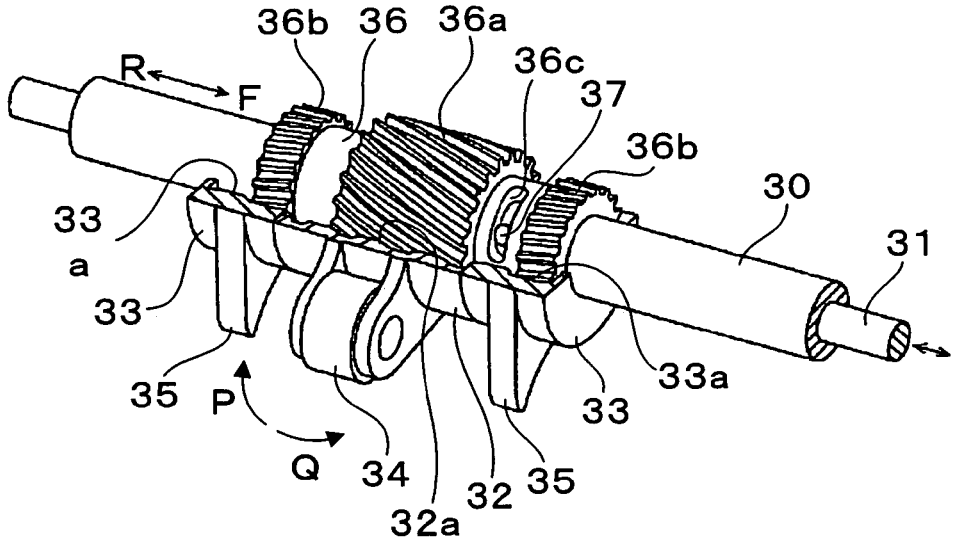
FIG. 6 is a partially cut-away perspective view of the valve-characteristics adjusting mechanism.

As shown in FIG. 6, the supporting shaft 30 is provided at its outer periphery with a slider 36. The slider 36 includes an elongated hole 36*c* extending in its circumferential direction. If a pin 37 mounted to the operation shaft 31 engages in the elongated hole 36*c*, the slider 36 can slide in the axial direction integrally with the operation shaft 31 with respect to the supporting shaft 30. The supporting shaft 30 is formed with an elongated hole (not shown) in the axial direction. The elongated holes permit the pin 37 to move in the axial direction. The slider 36 is integrally provided, at its outer periphery, with a first helical spline 36*a* and second helical splines 36*b* and 36*b* disposed such as to sandwich the first helical spline 36*a*. A twisting direction of the second helical spline 36*b* is opposite from that of the first helical spline 36*a*. The first ring 32 is formed, at its inner periphery, with a helical spline 32*a* which meshes with the first helical spline 36*a*. The second ring 33 is formed, at its inner periphery, with a helical spline 33*a* which meshes with the second helical spline 36*b*.

As shown in FIG. 4, the valve-characteristics adjusting mechanism 17 is added to the internal combustion engine 1 in such a manner that the roller follower 34 thereof is opposed to the cam 21A while the noses 35 are opposed to ends of the rocker arms 16 corresponding to the respective intake valves 4. If the roller follower 34 comes into contact with the nose section 21*a* and is pushed down as the cam 21A rotates, the first ring 32 supporting the roller follower 34 rotates on the supporting shaft 30, its rotation motion is transmitted to the second ring 33 through the slider 36, and the second ring 33 rotates in the same direction as that of the first ring 32. By the rotation of the second ring 32, the nose 35 pushes down one end of the rocker arm 16, the intake valve 4 is downwardly displaced against the valve spring 23 to open the intake port. If the nose section 21*a* gets over the roller follower 34, the intake valve 4 is pushed upward by a force of the valve spring 23 to close the intake port. In this manner, the rotation motion of the cam shaft 14A is converted into the opening and closing motion of the intake valve 4.

In the valve-characteristics adjusting mechanism 17, if the operation shaft 31 is displaced in the axial direction and the slider 36 is allowed to slide with respect to the supporting shaft 30 as shown in FIG. 6 with the arrows R and F, the first ring 32 and the second rings 33 are rotated in the opposite direction in the circumferential direction. When the slider 36 is moved in the direction of the arrow F, the first ring 32 is rotated in the direction of arrow P and the second rings 33 are rotated in the direction of arrow Q, and a distance between the roller follower 34 and the nose 35 in the circumferential direction is increased. On the other hand, if the slider 36 is moved in the direction of arrow R, the first ring 32 is rotated in the direction of arrow Q and the second rings 33 are rotated in the direction of arrow P, and the distance between the roller follower 34 and the nose 35 in the circumferential direction is reduced. As the distance between the roller follower 34 and the nose 35 is increased, the pushing-down amount of the rocker arm 16 by the nose 35 is increased. With this, the lift amount and the operation angle of the intake valve 4 are also increased. Therefore, as the operation shaft 31 is operated in the direction of arrow F shown in FIG. 6, the lift amount and the operation angle of the intake valve 4 are increased.

According to the valve-driving apparatus 11A configured as described above, if the cam shaft 14A is continuously driven in one direction at half the speed (called basic speed hereinafter) of rotation speed of the crank shaft of the internal combustion engine 1, the intake valve 4 can be opened and closed in synchronization with rotation of the crank shaft like a conventional mechanical valve-driving apparatus that drives the valve by the power from the crankshaft. Further, the lift amount and the operation angle of the intake valve 4 can be changed by the valve-characteristics adjusting mechanism 17. Further, according to the valve-driving apparatus 11A, by changing the rotation speed of the cam shaft 14A by the motor 12 from the basic speed, it is possible to change the correlation between the phase of the crank shaft and the phase of the cam shaft 14A, and to variously change the operation characteristics (valve-opening timing, valve-closing timing, lift characteristics, operation angle, maximum lift amount) of the intake valve 4.

As shown in FIG. 2, in the valve-driving apparatus 11B of the exhaust valve 5, unlike the valve-driving apparatus 11A, the cam shaft 14B is provided with two cams 21B, the valve-characteristics adjusting mechanism 17 is omitted, and the two cams 21B directly drive the rocker arms 16, respectively. Other portions of the valve-driving apparatus 11B are the same as those of the valve-driving apparatus 11A, and explanation of the same portions is omitted. Like the cam 21A, the entire periphery of a profile of the cam 21B comprises a projecting curved surface. The operation characteristics of the exhaust valve 5 can variously be changed by variously changing the driving speed of the cam shaft 14B by the motor 12 of the valve-driving apparatus 11B.

As shown in FIG. 2, the valve-driving system 10 is provided with a motor control apparatus 40 which controls the operation characteristics of the motors 12 of the valve-driving apparatuses 11A and 11B. The motor control apparatus 40 is a computer having a microprocessor, RAM and ROM as main storage devices, and the motor control apparatus 40 controls the operation of each electric motor 12 in accordance with a valve-controlling program stored in the ROM. Although the valve-driving apparatuses 11A and 11B of one cylinder 2 are shown in FIG. 2, the motor control apparatus 40 is also commonly used for valve-driving apparatuses 11A and 11B of another cylinder 2.

As an input device of information which is required for controlling the electric motor 12, there is connected to the motor control apparatus 40 an A/F sensor 41 which outputs a signal corresponding to an air fuel ratio of exhaust gas, a throttle opening sensor 42 which outputs a signal corresponding to a throttle valve opening for adjusting an intake air amount, an accelerator opening sensor 43 which outputs a signal corresponding to an opening of an accelerator pedal, an airflow meter 44 which outputs a signal corresponding to an intake air amount, and a crank angle sensor 45 which outputs a signal corresponding to an angle of the crank shaft. A value obtained from a predetermined function equation or map can also be used instead of actually measured values obtained by these sensors. A signal output from a position detecting sensor incorporated in the motor 12 is also input to the motor control apparatus 40.

Next, control of the motor 12 by the motor control apparatus 40 will be explained. In the following description, control of the motor 12 for driving the intake valve 4 of one cylinder 2 will be explained, but a motor 12 or driving an intake valve 4 of other cylinder 2 can be controlled in the same manner. A motor 12 for driving the exhaust valve 5 can also be controlled in the same manner.

FIG. 7 shows a motor driving control routine which is periodically executed repeatedly by the motor control apparatus 40 for changing the output torque of the motor 12 in accordance with the operation state of the internal combustion engine 1. By executing the motor driving control routine shown in FIG. 7, the motor control apparatus 40 functions as a motor control device. In this motor driving control routine, the motor control apparatus 40 detects a rotation position of the cam 21A based on, as an example, a position detecting sensor of the motor 12 and a speed reducing ratio of the gear train 15 in step S1. In this step S1, the motor control apparatus 40 functions as a cam position specifying device.

Next, in step S2, the operation state of the internal combustion engine 1 which is required for determining the operation details of the intake valve 4 is detected. For example, the revolution number (rotation speed) of the internal combustion engine 1, a load rate and the like are detected based on output signals of the sensors 41 to 45 described above. In next step S3, operation nature of the intake valve 4 are determined based on the result of detection of the operation state of the internal combustion engine 1. For example, parameters of the lift amount to be applied to the intake valve 4 in correspondence with the current operation state, the phase of the cam shaft 14A, the revolution number and the like are determined.

In step S4, an estimated value TF of the cam friction torque is obtained using the following equation (1). Here, a rotation resistance which is applied to the motor 12 based on mechanical structures from the motor gear 18 to the intake valve 4 or exhaust valve 5 is called cam friction torque.

$$TF(\theta+\theta 3)=Tf+f1(Tf1,\ \theta\max-\theta 1,\ \theta+\theta 3)+f2(Tf2,\ \theta\max+\theta 2,\ \theta+\theta 3) \quad (1)$$

Here, Tf represents a base friction torque, f1 represents a polynomial approximation function in which variation component of the cam friction torque generated by pushing and returning effect of the cam 21A by the valve spring 23 is described, f2 represents a polynomial approximation function in which variation component of the cam friction torque generated by pushing out effect of the cam 21A by the valve spring 23 is described, θ represents a crank angle when the control is executed, and θ3 represents a time constant determined according to the motor 12. The equation (1) will be explained with reference to FIGS. 8 and 9.

Figure 8:
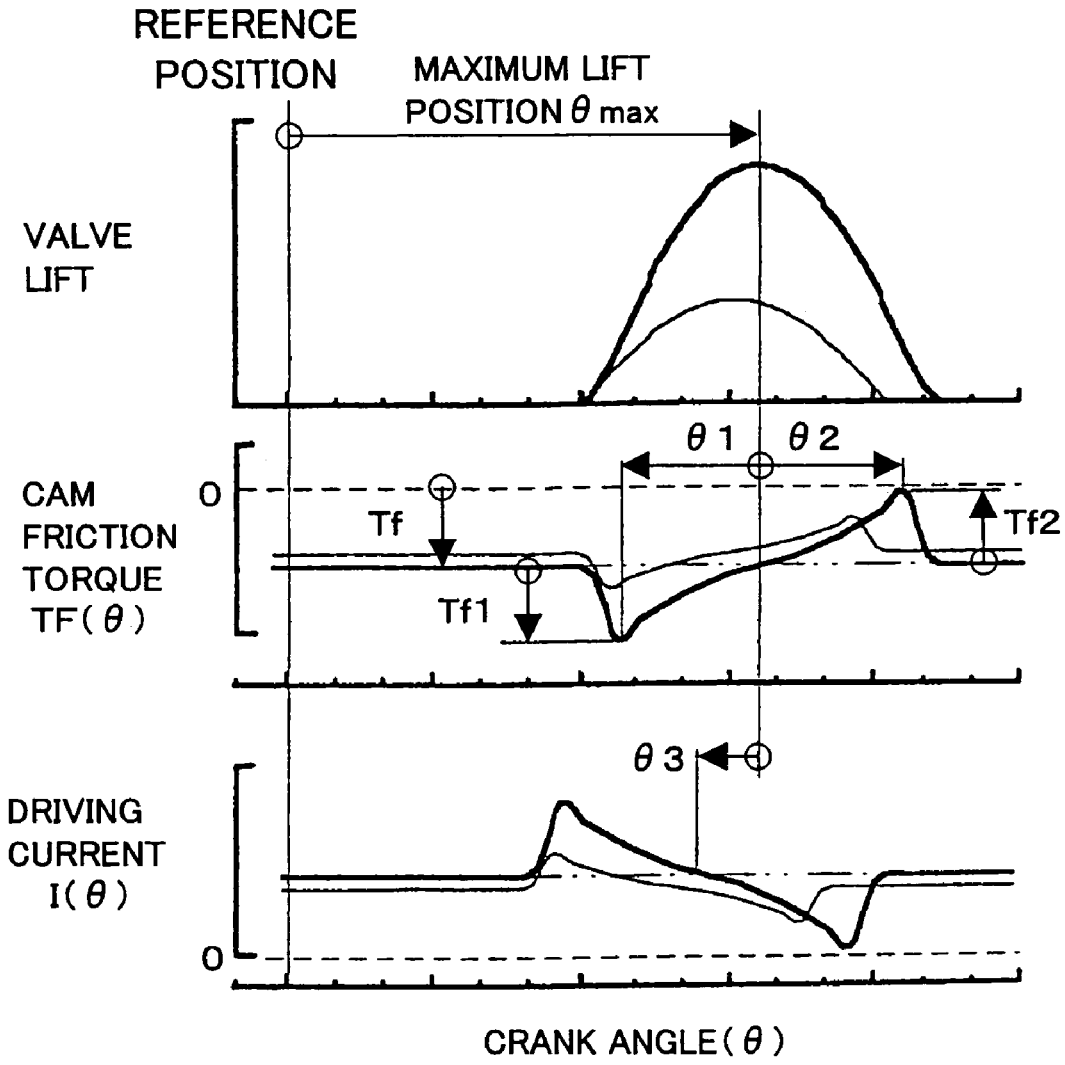
FIG. 8 shows one example of a relation between crank angle, valve lift, cam friction torque and motor driving current.

FIG. 8 shows a corresponding relation between the crank angle θ, the valve lift (lift amount of intake valve 4), the cam friction torque TF (θ) and driving current I (θ) of the motor 12. A normal direction of the cam friction torque TF, i.e., a direction of resistance against the rotation of the cam 21A is downward in FIG. 8. FIG. 8 also shows the cam friction torque TF and the driving current I of the motor 12 when the valve lift amount is changed in two stages, i.e., a large stage and a small stage. That is, a case in which the valve lift amount is large is shown with thick lines, and a case in which the valve lift amount is small is shown with fine lines.

As apparent from FIG. 8, a base friction torque Tf in the first term in the equation (1) acts in the normal direction, and its value is constant irrespective of the crank angle θ. That is, the base friction torque Tf shows a basic rotation resistance which is applied to the motor 12 when the cam 21A is rotated. Next, when an appropriate position on the lateral axis in FIG. 8 is defined as a reference position and the valve lift has a maximum value at a position (called maximum lift position, hereinafter) where the crank angle θ advances from the reference position by θmax, the cam friction torque TF (θ) is increased in the normal direction more than the base friction torque Tf during a course of opening of the intake valve 4 before the cam friction torque TF (θ) reaches the maximum lift position θmax and shows a peak, and the cam friction torque TF (θ) is reduced in the negative direction smaller than the base friction torque Tf during a course of closing of the intake valve 4. This is because that such a change in the friction torque TF (θ) functions such that the reaction force of the valve spring 23 pushes and returns the cam 21A in a direction opposite from its rotation direction when the cam 21A opens the intake valve 4 against the valve spring 23, and after the reaction force of the valve spring 23 exceeds the peak, the reaction force of the valve spring 23 functions such as to push out the cam 21A in the rotation direction.

Strictly, a variation amount of the cam friction torque TF corresponding to an arbitrary crank angle θ from the base friction torque Tf can be calculated in terms of mechanics or mechanism from a structure of the valve-driving apparatus 11A. However, the a correlation between the crank angle θ and the variation amount of the cam friction torque TF can be expressed, in an approximation manner, by functions using, as variables, peak values Tf1, Tf2 of the variation amount of the cam friction torque with respect to the base friction torque Tf, and deviation amounts θ1, θ2 of the crank angle θ provided with the peak values Tf1, Tf2 from the maximum lift position θmax. The second terms f1, f2 in the equation (1) are approximate functions obtained from such view point. Information for specifying these approximate functions is stored in the ROM of the motor control apparatus 40.

Figure 9:
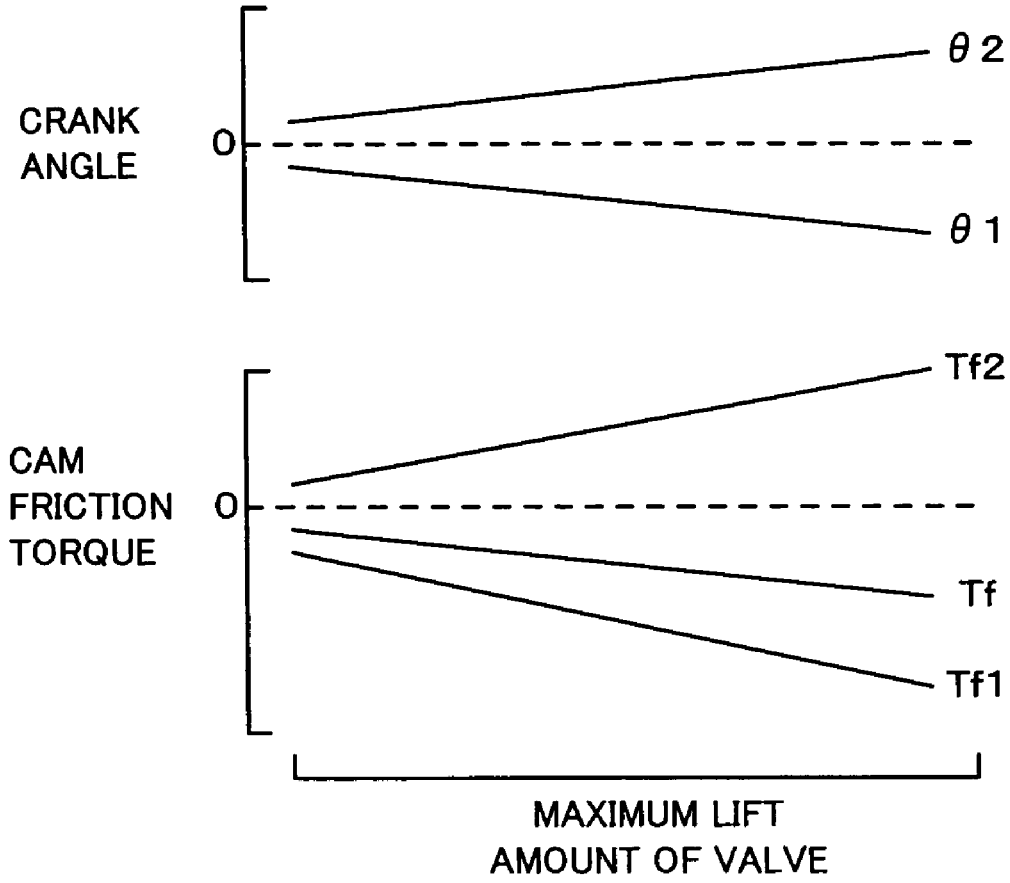
FIG. 9 shows one example of a corresponding relation between maximum lift amount of the valve, crank angle and cam friction torque.

The maximum lift position θmax is determined in the processing in step S3 in FIG. 7. As shown in FIG. 9, there exists a correlation between the maximum lift amount of the intake valve 4, the base friction torque Tf, the peak values Tf1, Tf2, and the crank angle deviation amounts θ1, θ2. The relation is previously stored in the ROM of the motor control apparatus 40 in a form of a map. Therefore, in the processing of step S4, the motor control apparatus 40 first obtains the base friction torque Tf, the peak values Tf1, Tf2 and the crank angle deviation amount θ1, θ2 corresponding to the current maximum lift amount with reference to the map in the ROM, substitutes these values and the current crank angle θ which is specified based on the output of the crank angle sensor 45 into the equation (1), and obtains the cam friction torque TF. When these values are corrected in step S10 or S11, the correction is reflected and the cam friction torque TF is obtained.

However, the response of the motor 12 delays, and when the response delay is indicated with time constant θ3 in terms of the crank angle θ, it is necessary to obtain, at the current time, the cam friction torque TF when the crank angle θ advances from the current crank angle θ by the time constant θ3. For this reason, the time constant θ3 is added to the crank angle θ in the second and third terms in the equation (1). The variation component of the cam friction torque may be obtained by a physical model instead of the polynomial approximation function f1, f2.

Explanation will be continued referring back to FIG. 7. After the cam friction torque TF is calculated, the procedure proceeds to step S5, where cam friction torque TF (θ+θ3) is multiplied by predetermined gain α to obtain the driving current I (θ) of the motor 12 to be given at the current time. In step S6, the current is set to the driving current I (θ) for the motor 12 to drive the motor 12. As apparent from FIG. 8, the motor driving current I (θ) given in step S6 is reflected by the change of the cam friction torque TF (θ) which is advanced by the motor time constant θ3. Therefore, when the cam friction torque TF (θ) becomes greater than the base friction torque Tf (when it is changed to the lower side in FIG. 8), the output torque of the motor 12 is increased correspondingly, and when the cam friction torque TF (θ)

becomes smaller than the base friction torque Tf (when it is changed to the upper side in FIG. 8), the output torque of the motor 12 is reduced correspondingly. With this, the output torque of the motor 12 is controlled in proper degree.

After the motor 12 is driven, the procedure proceeds to step S7, where it is judged whether a difference between the current driving current I (θ) and a standard driving current I (θ) is within a predetermined threshold value λ. The standard driving current I (θ) is a driving current which can be obtained without taking, into account, the correction made in step S10 or S11. If it is judged in step S7 that the difference is within the threshold value λ, the procedure proceeds to step S8, where it is judged whether a value obtained by subtracting an air fuel ratio (measured A/F) detected by the A/F sensor 41 by a target air fuel ratio (target A/F) is equal to or less than a predetermined threshold value β. Here, the target A/F is a target value of the air fuel ratio which is set in accordance with the operation state of the internal combustion engine 1. Since the valve-operating characteristics of the intake valve 4 are appropriately set in accordance with the operation state of the internal combustion engine (see step S3), the target A/F corresponds to the air fuel ratio which would be obtained if the operation state of the intake valve 4 is appropriately controlled.

When the measured A/F increases more than the target A/F and exceeds the threshold value β and the condition in step S8 is denied, i.e., when the actual air fuel ratio is largely deviated from the threshold value β toward the rich side with respect to the target air fuel ratio, the procedure proceeds to step S10, at least one of parameters of crank angle deviation amounts θ1, θ2 and the peak values Tf1, Tf2 of the variation amount of the cam friction torque which is to be substituted into the equation (1) is reduced from the value specified by the map in FIG. 9 by an amount corresponding to a difference in the air fuel ratio. To reduce the peak values Tf1, Tf2 is to change these values such that the values come closer to the base friction torque Tf. By changing in this manner, the intake valve 4 is controlled into a direction relatively closing the valve, i.e., in a direction in which the lift amount is reduced. Therefore, in step S10, the lift amount of the intake valve is reduced to relatively reduce the intake air amount, thereby attempting to cancel the deviation between the measured A/F and the target A/F.

When the condition in step S8 is satisfied, the procedure proceeds to step S9, where it is judged whether a value obtained by subtracting the target A/F by the measured A/F is equal to or smaller than a predetermined threshold value γ. If the condition in step S9 is satisfied, the motor driving control routine of this time is completed. When the measured A/F is reduced lower than the target A/F beyond the threshold value γ so that the condition in step S9 is denied, i.e., when the actual air fuel ratio is largely deviated from the threshold value γ toward the lean side with respect to the target air fuel ratio, the procedure proceeds to step S11, where at least one of parameters of the crank angle deviation amounts θ1, θ2 and peak values Tf1, Tf2 of the variation amount of the cam friction torque which is to be substituted into the equation (1) is increased by an amount corresponding to a difference of the air fuel ratio from the value specified by the map in FIG. 9. To increase the peak values Tf1, Tf2 is to change these values such that they are separated from the base friction torque Tf. With this change, the intake valve 4 is controlled in a direction in which the valve is relatively opened, i.e., in a direction in which the lift amount is increased. Therefore, in step S11, the lift amount of the intake valve 4 is increased to relatively increase the intake air amount, thereby attempting to cancel the deviation between the measured A/F and the target A/F.

After the variable θ1, θ2, Tf1 or Tf2 is corrected in step S10 or S11, the procedure proceeds to step S12. In step S12, it is judged whether a fluctuation amount of the parameter is greater than a threshold value ψ. If the fluctuation amount of the parameter is equal to or smaller than the threshold value ψ, the procedure returns to step S4, where the cam friction torque TF is calculated. At that time, if the variable θ1, θ2, Tf1 or Tf2 is corrected in step S10 or S11, the corrected value is used.

If it is judged that the fluctuation amount is greater than the threshold value ψ in step S12, it is judged that the valve-driving apparatus 11A is abnormal, and the procedure proceeds to step S13, where a predetermined alarm is given to inform an operator of the abnormality of the valve-driving apparatus 11A. For example, an alarm lamp on an instrument panel of a vehicle lights up or blinks. Then, procedure proceeds to step S15, where predetermined retreating running is started and the motor driving control routine is completed. When the difference in driving current I (θ) exceeds the threshold value λ in step S7, it is judged that the motor 12 is abnormal and the procedure proceeds to step S14, where a predetermined alarm is given to inform an operator of the abnormality of the motor 12. For example, an alarm lamp on an instrument panel of the vehicle lights up or blinks. Then, procedure proceeds to step S15.

According to the embodiment, since the output torque of the motor 12 is controlled in proper degree in accordance with the increase or reduction of the cam friction torque, it is possible to suppress the deviation in rotation speed of the cam shaft 14A due to influence of the fluctuation in cam friction torque, and to precisely control the operation characteristics of the cam 21A with respect to the target value. Therefore, the fuel consumption and power performance of the internal combustion engine 1 are enhanced, and the exhaust emission is prevented from being deteriorated.

The deviation of the air fuel ratio is specified and the output torque of the motor 12 is controlled such that the deviation is corrected. Therefore, it is possible to appropriately control the output torque of the motor 12 in accordance with an actual state of the valve-driving apparatus 11A without having a dependence on the target value of control only. For example, when the state of the valve-driving apparatus 11A is different from the state at the time of setting the approximate functions f1, f2 shown in FIG. 8 and the map shown in FIG. 9 due to physical difference or secular change of the valve-driving apparatus 11A, the difference appears as variation of the air fuel ratio. Therefore, if the driving current of the motor 12 is controlled such that the deviation of the air fuel ratio is corrected, the operation characteristics of the intake valve 4 can appropriately be controlled while properly reflecting the state of the valve-driving apparatus 11A as a result. Since the driving current of the motor 12 corrected in this manner properly reflects the lift amount and the phase of the intake valve 4, the intake air amount into the cylinder 2 can precisely be calculated based on the corrected driving current of the motor 12.

According to the embodiment, when the driving current of the motor 12 is set extremely larger or smaller than the standard driving current, it is judged that the motor 12 is abnormal (steps S7→S14), and when a parameter correcting amount (fluctuation amount) corresponding to the deviation of the air fuel ratio is larger and exceeds a permissible level, it is judged that the valve-driving apparatus is abnormal (steps S12→S13). With this, the motor control apparatus 40 functions as an abnormality judging device. If the driving current of the motor 12 is excessively larger or smaller than the standard driving current, the possibility that the motor 12 is not operated normally is high. When the correction amount which is necessary to cancel the deviation of the air fuel ratio is excessively large in the normal or negative direction even if the driving current is normal, the possibility that any of the valve-driving apparatuses 11A is abnormal and the intake valve 4 is not properly driven is high. Therefore, according to the embodiment, it is possible to appropriately judge the abnormality of the valve-driving system 10. Since the abnormality of the motor 12 and the valve-driving apparatus 11A is judged based on the correction amount of the driving current of the motor 12, it is unnecessary to separately provide a sensor which monitors the operation state of the valve-driving apparatus 11A for troubleshooting, and the costs can be prevented from increasing.

The correction of the output torque of the motor in steps S8 to S11, and the judgment whether the abnormality exists in step S7 or S12 are not inherent in a feedforward control of the output torque of the motor based on estimation of the friction torque, and they may be carried out in combination with respect to various controls concerning the motor 12. For example, it is possible to correct or judge the abnormality of the output torque like the example shown in FIG. 7 for the feedback control of the output torque of the motor 12 based on the revolution number of the crank shaft.

In the embodiment, the fluctuation amount obtained in step S10 or S11 is desirably stored in the storing device in the motor control apparatus 40 as a correction amount of the friction torque TF. The storing device in this case is desirably a vehicle battery-protected backup RAM, or a non-volatile memory such as a writable memory holding flush ROM which needs no electricity supply to store the memorized contents. If such a storing device is utilized, the correction amount can be held even after the ignition switch is turned OFF and the internal combustion engine 1 is stopped, and when the internal combustion engine 1 is started next time, it is possible to appropriately calculate the cam friction torque TF with reference to the stored correction value.

The feedforward control of the motor output torque based on the estimation of the cam friction torque may be carried out concurrently with another control concerning the motor output torque, or may be carried out alone. For example, it is possible to concurrently carry out the feedback control of the cam angle based on the crank angle detected by the crank angle sensor 45 and the feedforward control of the cam friction torque.

The valve-driving system 10 of the embodiment has several features in addition to the above-described basic structure for controlling the operations of the intake valve 4 and exhaust valve 5 in accordance with the operation state of the internal combustion engine 1. The features will be explained below. Various mechanisms and structures of the intake-side valve-driving apparatus 11A are also provided for the exhaust-side valve-driving apparatus 11B, and they exhibit the same effects as those of the valve-driving apparatus 11A unless otherwise specified.

(Concerning Detection of Position of Cam)

In the valve-driving system 10 of this embodiment, the position of the cam 21A is specified utilizing a rotation position detecting device of the motor 12 (see step S1 in FIG. 7). Preferably, a pair of magnetic pole sensors is used for the rotation position detecting device. The same number of S poles and N poles are disposed around an output shaft of the magnetic pole sensor, and rotation signals of 0° to 360° are output while the output shaft is rotated in the order of S pole→N pole→S pole, or N pole→S pole→N pole. In a normal motor, the number of magnetic poles of the magnetic pole sensor is the same as the number of magnetic poles of the motor 12. For example, if the motor 12 has four pairs of poles (one S pole and one N pole make one pair), the magnetic pole sensor has four pairs of poles, and if the motor 12 has eight pairs of poles, the magnetic pole sensor also has eight pairs of poles. However, in this embodiment, a magnetic pole sensor having one pair of poles is used as a position detecting sensor of the motor 12 irrespective of the number of poles of the motor 12. According to this structure, since the rotation position of the output shaft of the motor 12 and the output signal of the position detecting sensor correspond to each other in a 1:1 manner, there is a merit that the rotation position of the motor 12 can easily be found. When, a speed ratio of the motor 12 and the cam shaft 14A is 1:1, since the rotation position of the motor 12 and the rotation position of the cam 21A correspond to each other in a 1:1 manner, the rotation position of the motor 12 is the rotation position of the cam 21A, which is convenient.

Figure 10:
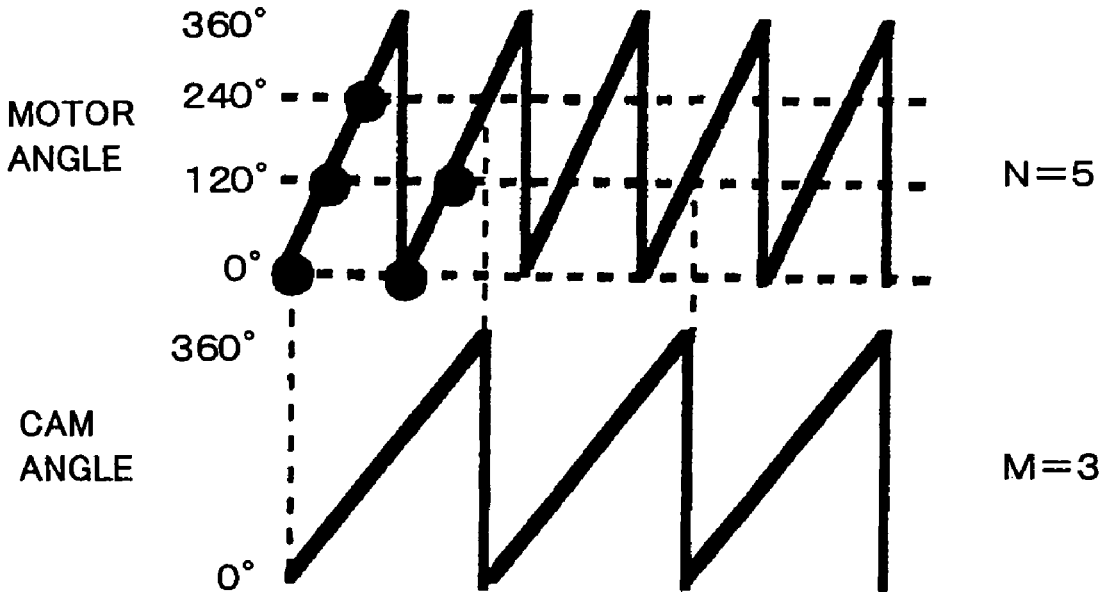
FIG. 10 shows one example of a corresponding relation between cam angle and motor angle.

When the speed reducing ratio from the motor 12 to the cam shaft 14A can not be set to 1:1 for any reason of the gear train 15 or the like, since it can not be determined to which rotation position of the cam 21A the rotation position of the motor 12 corresponds, the rotation position of the cam 21A can not be controlled unless the initializing operation for specifying the corresponding relation therebetween is carried out. The initializing operation can be carried out by actually driving the cam 21A to detect which rotation position of the motor 12 the predetermined cam angle corresponds. When the speed reducing ratio from the motor 12 to the cam 21A is N:M (wherein N>M, and N and M are integers having no common divisors except 1), rotation positions (motor angle) of the motor 12 which corresponds to a specific cam angle of 0 to 360° exist in N locations between the cam angles of 0 to 360°, i.e., exist in every 360/N°. For example, when the speed reducing ratio is set to N:M=5:3 as shown in FIG. 10, since the cam 21A rotates three times while the motor 12 rotates five times, one of five locations (shown with black circles in FIG. 10) while the cam 21A rotates once corresponds to the cam angle of 0°. Thus, as the N is smaller, the cam position can be detected easier. If a motor angle corresponding to a specific cam angle is set to 60°/one turn or larger while taking a margin for error detection into account, a preferable range of N is 6 or lower.

(Concerning Initializing Operation of Cam)

Figure 11:
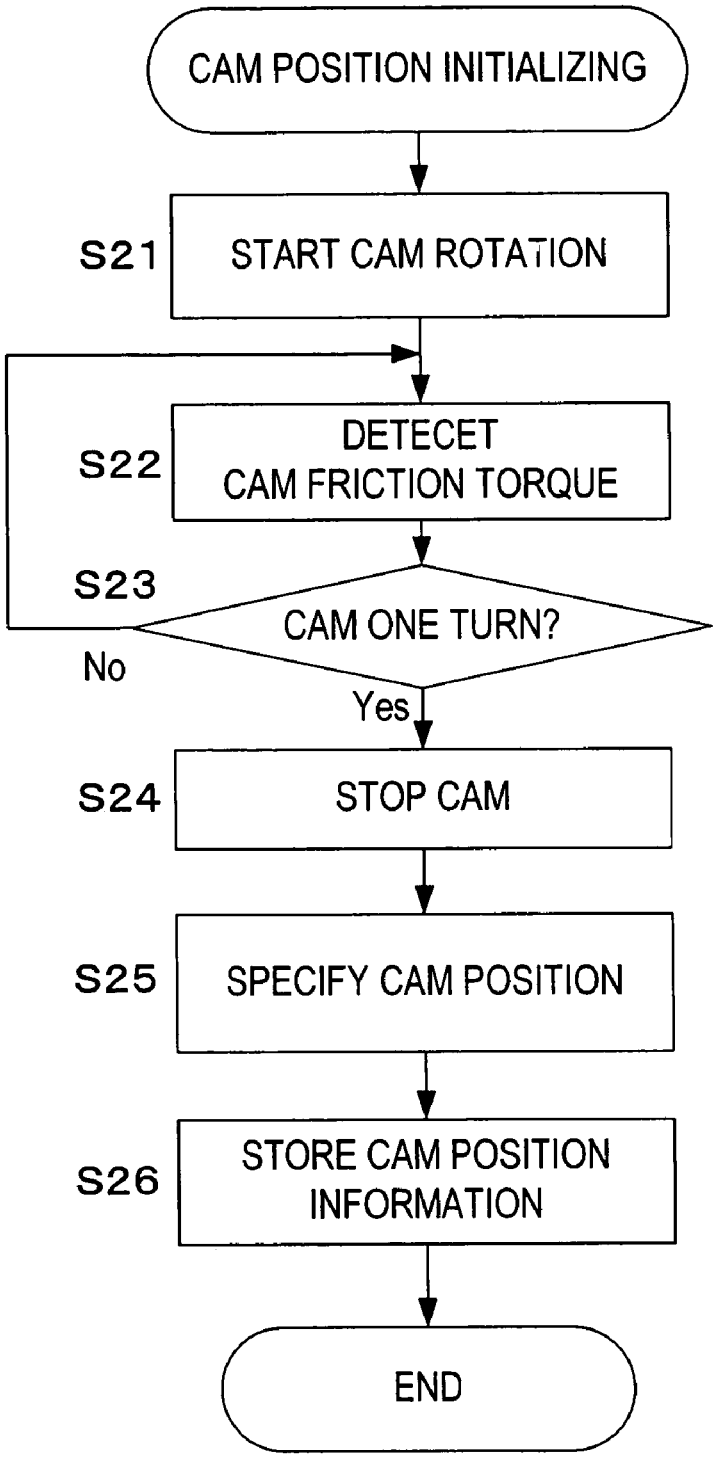
FIG. 11 is a flowchart showing procedure of a cam position initializing routine which is executed by the control apparatus shown in FIG. 2.

Next, the initializing operation concerning the cam position will be explained. FIG. 11 shows a cam position initializing routine which is executed by the motor control apparatus 40 to initialize the cam position. By executing the cam position initializing routine shown in FIG. 11, the motor control apparatus 40 functions as the initializing device. In this routine, the motor control apparatus 40 first starts the motor 12 to rotate the cam 21A in step S21. At this time, the rotation speed of the motor 12 is fed back utilizing a position signal or the like from the rotation position sensor, and the output torque of the motor 12 is controlled such that the rotation speed becomes constant. The output torque is controlled by increasing or reducing the driving current. In step S22, the cam friction torque is detected utilizing the feedback-controlled driving current. In step S23, it is judged whether the motor 12 rotates by an amount corresponding to one turn of the cam 21A. If the result is negative in step S23, the procedure returns to step S22. If the cam 21A rotates once, the cam is stopped in step S24, and the procedure proceeds to step S25.

Figure 12A:
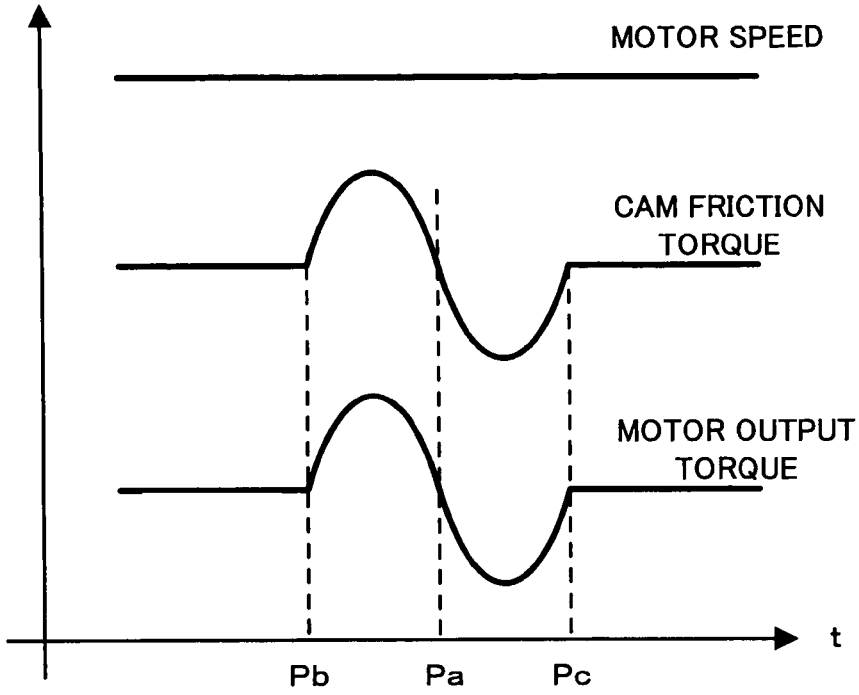
FIGS. 12A and 12B show one example of a correlation between motor speed, cam friction torque and motor output torque.

In step S25, the corresponding relation between the position of the cam 21A and the rotation position of the motor 12 is specified based on the result of detection of the cam friction torque. That is, if the motor speed is constant as shown in FIG. 12A, there is a correlation between the cam friction torque and the motor output torque, and if the cam friction torque is increased from a position Pa where the cam 21A starts opening the intake valve 4, the output torque is also increased, the cam friction torque and the motor output torque are inverted at a position Pb where the nose section 21*a* of the cam 21A reaches an extension of the intake valve 4, and the cam friction torque and the motor output torque are converged into their base values at a position Pc where the intake valve 4 is completely closed and the cam 21A is separated. In an actual case, there is an influence of the motor time constant as shown in FIG. 8 but in FIGS. 12A and 12B, the time constant of the motor 12 is ignored.

If such a relation between the cam friction torque and the motor output torque is utilized, it is possible to discriminate at least one of the cam positions Pa, Pb and Pc, and to grasp the corresponding relation between the discriminated position and the rotation position of the motor 12. The current cam position (cam angle) is specified in step S25 shown in FIG. 11 utilizing the corresponding relation. In step S26, information concerning the cam position specified by the initializing operation is stored and then, the initializing operation routine is completed.

Figure 12B:
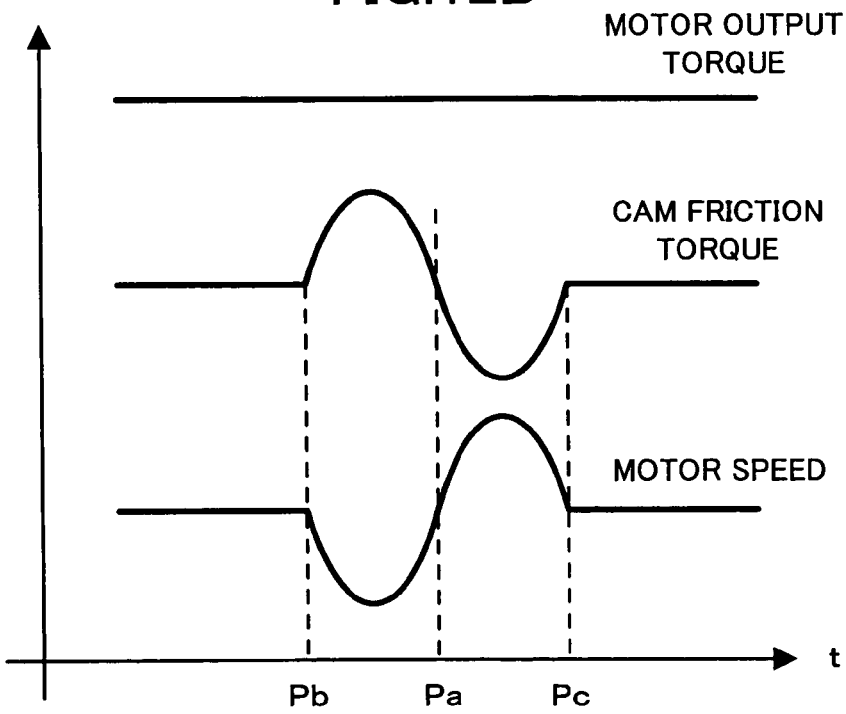

According to this processing, since the cam position can be specified from the variation of the motor output torque, there is a merit that it is unnecessary to separately provide a sensor for detecting the cam position. However, the present invention is not limited to the specifying operation of the cam position based on the motor output torque. For example, as shown in FIG. 12B, when the motor output torque is maintained at constant level and the cam 21A is rotated, the rotation speed of the motor 12 is changed in accordance with the cam friction torque. Therefore, it is possible to obtain the motor speed or acceleration utilizing a signal from the rotation position sensor of the motor 12, and to specify the cam position from the change of the speed or acceleration. In any case, if the various physical amounts having the correlation with respect to the variation of the cam friction torque are monitored, the cam position can be specified.

The above-described cam position initializing routine can be carried out when the internal combustion engine 1 is started or stopped. More concretely, when the ignition switch is turned ON, the cam position initializing routine is carried out prior to the cranking operation, or when the ignition switch is turned OFF and the stop of the internal combustion engine 1 is confirmed, the cam position initializing routine is carried out before the power supply to the motor control apparatus 40 is stopped. When the initializing operation is carried out when the ignition switch is turned ON, if the motor control apparatus 40 can refer to the obtained cam position information, the information can be stored in various storing devices. On the other hand, when the initializing operation is carried out when the ignition switch is turned OFF, the obtained cam position information is stored in a vehicle battery-protected backup RAM, or a non-volatile memory such as a writable memory holding flush ROM which needs no electricity supply to store the memorized contents. If such a storing device is utilized, it is unnecessary to initialize when the internal combustion engine 1 is started, and it is possible to immediately start controlling the cam 21A utilizing the stored cam position.

The execution timing of the cam position initializing routine is not limited to the immediately after turning ON or OFF of the ignition switch, and the routine may be carried out any time if necessary only if the operation of the internal combustion engine 1 is not affected. For example, the cam position initializing routine may be executed during the execution of idling stop, and the cam initializing routine may be carried out for the cam 21A corresponding to the stopped cylinder (cylinder in which the combustion is stopped) when combustion in one or several cylinders is stopped during deceleration or the like, i.e., during operation in which the number of cylinders is reduced.

(Concerning Electricity Generation Utilizing Cam Rotation)

Figure 13:
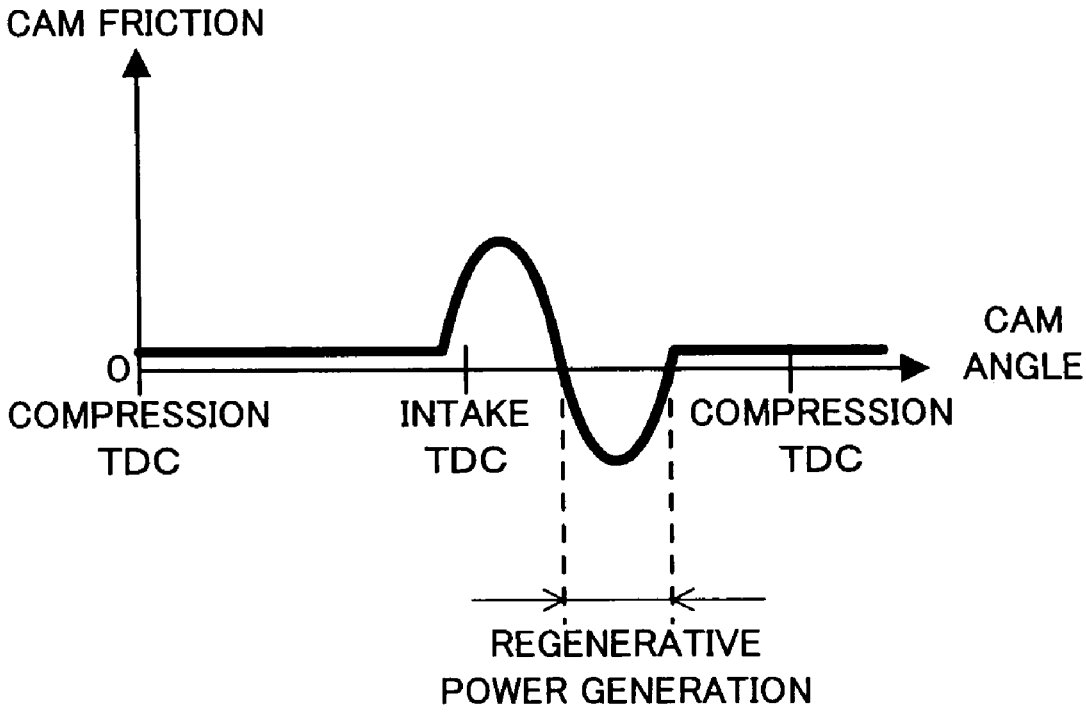
FIG. 13 shows an example in which the cam friction torque assumes a negative value.
Figure 14:
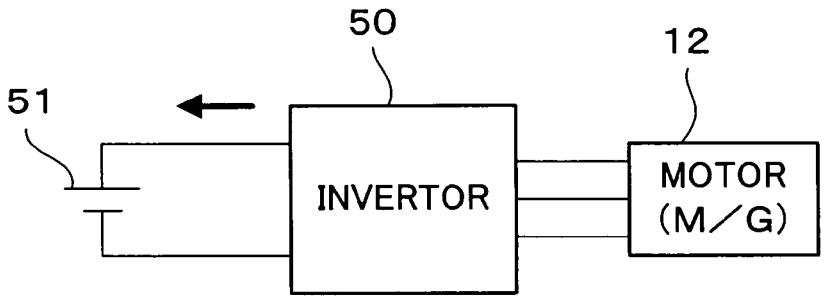
FIG. 14 shows a structure for generating electricity in a regenerative manner in a cam-driving motor.

In FIG. 8, the cam friction torque TF (θ) is always greater than 0, and driving current is supplied to the motor 12 through one turn of the cam 21A. However, the cam friction torque TF assumes a negative value as shown in FIG. 13 and the output shaft of the motor 12 is rotated by a reaction force of the valve spring 23 depending upon a magnitude relation between the force of the valve spring 23 to push out the cam 21A and the base friction torque Tf. If such a state is generated, electricity may be generated using the motor 12 (called motor generator in some cases) as shown in FIG. 14 also, and the obtained electric power may be charged into a battery 51 through an inverter circuit 50, thereby applying appropriate load to the rotation of the cam 21A.

[Second Embodiment]

A second embodiment of the present invention will be explained. In the first embodiment, the cam friction torque is estimated and the output torque of the motor 12 is controlled. In the second embodiment, the variation in the revolution number (rotation speed) of the internal combustion engine 1 is estimated based on the operation state of the internal combustion engine 1, and the output torque of the motor 12 is controlled in accordance with the result of the estimation. The mechanical structures of the valve-driving apparatuses 11A and 11B are the same as those in the first embodiment.

Figure 15:
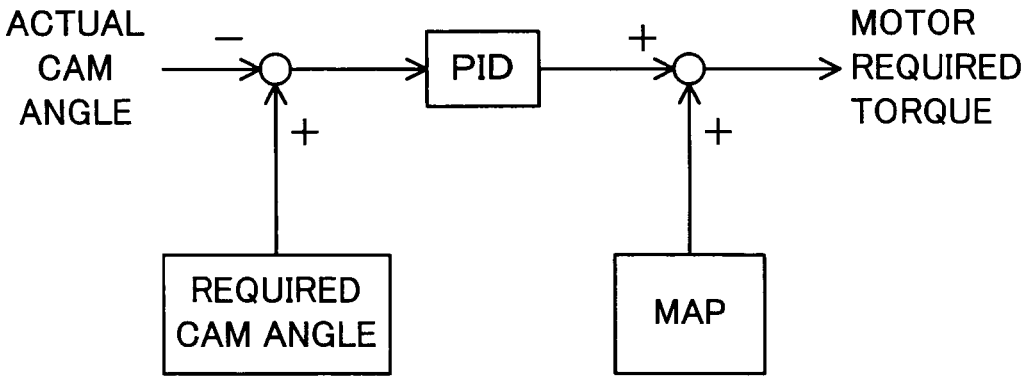
FIG. 15 is a block diagram of a control system for estimating the variation in the number of revolution of an internal combustion engine and for controlling the output torque of the motor in a second embodiment of the present invention.

FIG. 15 is a block diagram of a control system mounted in the motor control apparatus 40 of the second embodiment of the present invention. This structure may be realized by a combination between a CPU and software or by a hardware circuit. In this embodiment, a required cam angle as a control target value is calculated based on the crank angle detected by the crank angle sensor 45 and a valve timing (required valve timing) required in accordance with the operation state of the internal combustion engine 1. A deviation between the required cam angle and the actual cam angle provided as input information is obtained, and the output torque of the motor 12 is PID controlled based on the deviation.

According to a control system shown in FIG. 15, several parameters related to the change of the revolution number of the internal combustion engine 1 are monitored (here, the monitored parameters are accelerator opening, intake air amount, fuel injection amount), and a correction amount of output torque corresponding to the parameters is obtained utilizing a predetermined map. When an automatic transmission is provided in the vehicle, the shift position may be monitored as the parameter. The shift position can be obtained by referring to the shift diagram of the transmission. A corresponding relation between each parameter and the correction amount may be obtained by a bench adaptability test or computer simulation.

A value in which the correction amount of the output torque obtained based on the map is added to an output torque obtained by the PID control is output as the required torque. The motor control apparatus 40 controls the driving current of the motor 12 based on this required torque.

In this embodiment, the change of the revolution number of the internal combustion engine 1 is indirectly estimated through the accelerator opening or the like, the correction amount of the motor output torque is provided from the map in accordance with the result of the estimation, and the output torque of the motor 12 is feedforward controlled. Therefore, the response of the driving speed of the cam with respect to the change of the revolution number of the internal combustion engine 1 can be quickened.

Figure 16:
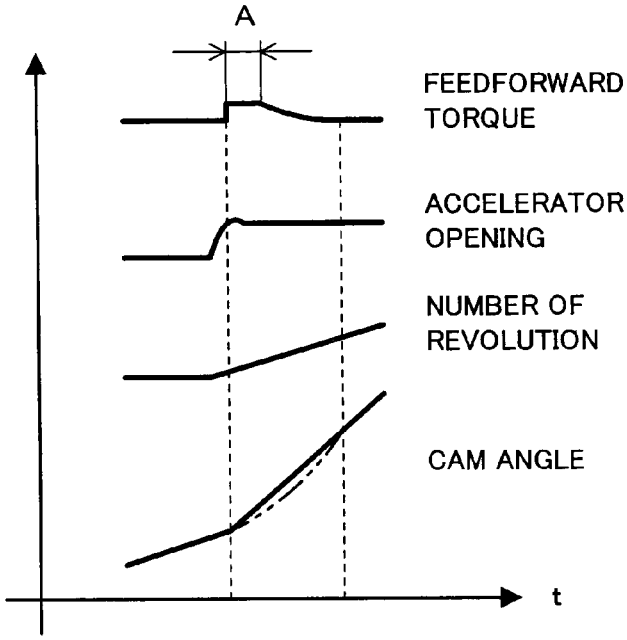
FIG. 16 shows one example of control which is realized by the control system shown in FIG. 15.

FIG. 16 shows an example of the feedforward control of the cam output torque when the change of the revolution number is estimated based on the accelerator opening. In the drawing, the feedforward torque means a correction amount of the output torque specified from the map in the control system shown in FIG. 15, and does not mean the required torque itself. In the example shown in FIG. 16, the feedforward torque is increased by a predetermined amount during a constant time period A in correspondence to the rapid increase of the accelerator opening. If the accelerator opening is increased, the revolution number of the internal combustion engine 1 is increased, but the actual cam angle delays as shown with the chain double-dashed line in the drawing with respect to the required cam angle shown with the solid line in the drawing if the feedforward torque is not provided. For example, there is a possibility that the cam angle delays only by feedback controlling the output torque of the motor 12 based on the revolution number of the internal combustion engine 1. However, if the feedforward torque is provided, it is possible to substantially bring the required cam angle and the actual cam angle into agreement with each other, and the response of the cam can be quickened.

Figure 17:
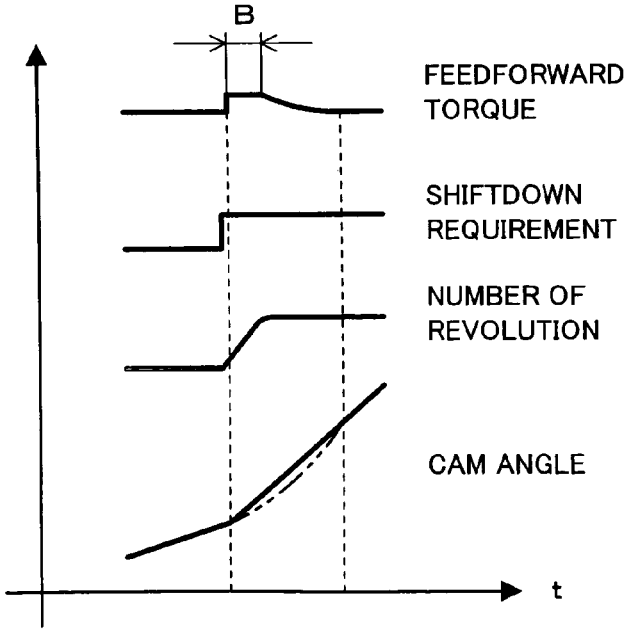
FIG. 17 shows another example of control which is realized by the control system shown in FIG. 15.

FIG. 17 shows an example of the feedforward control of the cam output torque when the change of the revolution number is estimated based on the shift position. In this example, when shift down is required based on the shift diagram of the transmission, the feedforward torque is increased by a predetermined amount only for a constant time period B in correspondence to the requirement. If the shift down is carried out, the revolution number of the internal combustion engine 1 is increased, but if the feedforward torque is not provided, the response delay is generated in the actual cam angle as shown with the chain double-dashed line in the drawing with respect to the required cam angle shown with a solid line in the drawing. If the feedforward torque is provided, it is possible to substantially bring the required cam angle and the actual cam angle into agreement with each other even when the shift down is carried out, and the response of the cam can be quickened.

Other than the above examples, the change of the revolution number may be estimated by referring to various parameters having correlation with respect to the change of the revolution number of the internal combustion engine 1. The feedforward control of the motor output torque based on the estimation of the revolution number change may be carried out in parallel to the other control concerning the motor output torque, or may be carried out alone. For example, at least one of the feedback control of the cam angle based on the crank angle detected by the crank angle sensor 45 and a feedforward control based on the estimation of the cam friction torque in the first embodiment may be carried out together with the feedforward control in the second embodiment.

[Third Embodiment]

Next, a third embodiment of the present invention will be explained. In this embodiment, the driving modes of the motors 12 of the valve-driving apparatuses 11A and 11B are switched between a normal rotation mode and a normal-reverse rotation mode in accordance with the operation state of the internal combustion engine 1. The normal rotation mode is a mode in which the motor 12 is continuously rotated in a constant direction (normal direction), and the normal-reverse rotation mode is a mode in which the rotation direction of the motor 12 is switched appropriately between the normal rotation direction and the reverse rotation direction. The mechanical structures of the valve-driving apparatuses 11A and 11B are the same as those in the first embodiment.

Figure 18:
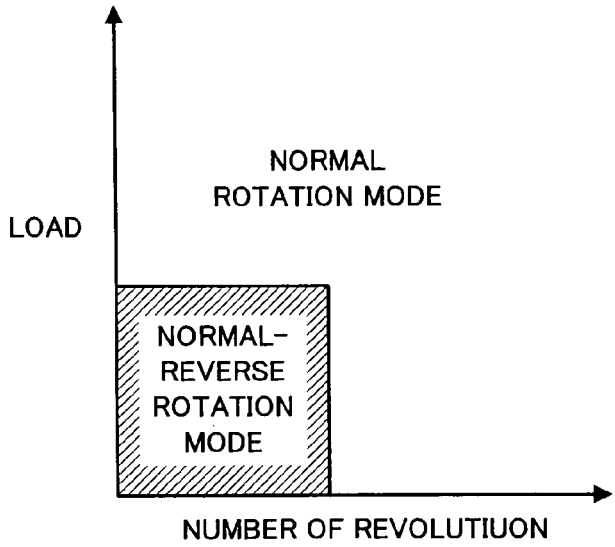
FIG. 18 shows a condition for switching driving modes of the motor between a normal rotation mode and normal-reverse rotation mode in a third embodiment of the present invention.

FIG. 18 shows one example of switching conditions concerning the driving mode of the motor 12. In this example, the motor driving mode is switched based on the revolution number and a load of the internal combustion engine 1. The driving mode is switched to the normal rotation mode at the time of high rotation under high load, and the driving mode is switched to the normal-reverse rotation mode at the time of low rotation under low load. In the normal-reverse rotation mode, the rotation direction of the motor 12 is switched at an arbitrary position during a course of opening of the intake valve 4 or exhaust valve 5, thereby closing the intake valve 4 or exhaust valve 5 before the cams 21A and 21B reach the maximum lift position, i.e., before the intake valve 4 or exhaust valve 5 reaches a position where the maximum lift amount is provided.

Figure 19:
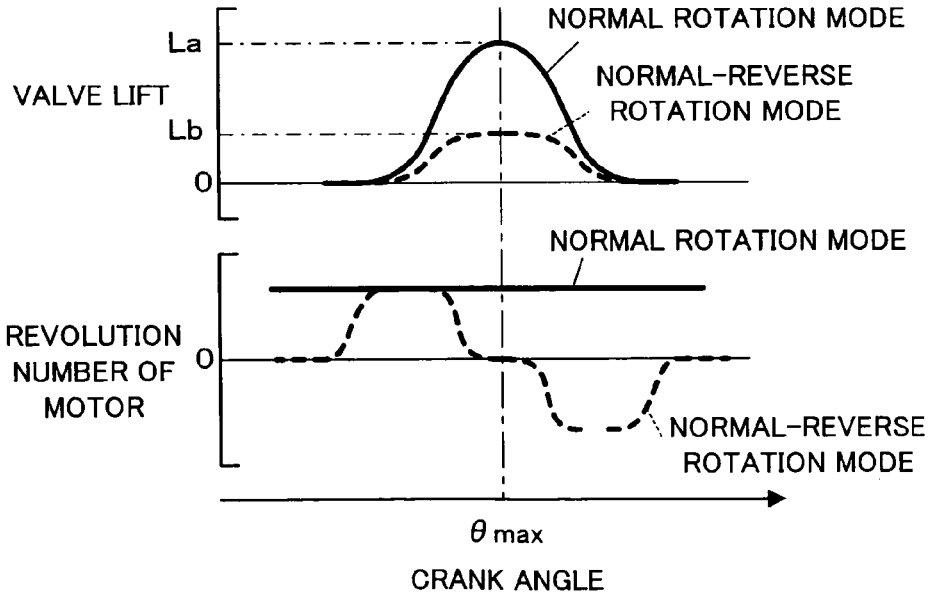
FIG. 19 shows a corresponding relation between crank angle, valve lift and the number of revolution of the motor in the normal rotation mode and normal-reverse rotation mode.

That is, as shown in FIG. 19, when the maximum lift amount is La when the motor 12 is rotated in the normal rotation mode, if the motor 12 is once stopped before the cams 21A and 21B reach the maximum lift position θmax in the normal-reverse rotation mode and then the motor 12 is reversely rotated, it is possible to limit the maximum lift amount of the intake valve 4 and exhaust valve 5 to a smaller amount Lb. With this, it is possible to prevent the intake air amount from excessively increasing. It is also possible to select the normal-reverse rotation mode at the time of start of the internal combustion engine 1 to realize a decompression function (function for lowering the compression pressure by opening the intake valve 4 or exhaust valve 5) having excellent response. On the other hand, if the normal rotation mode is applied at the time of high rotation under high load, it is possible to rotate the cams 21A and 21B at high speed with relatively small torque utilizing inertia of the cams 21A and 21B, the gear train 15 and the like.

The lift amount Lb in the normal-reverse rotation mode may appropriately be changed in accordance with the operation state of the internal combustion engine 1. In order to change the lift amount Lb, the rotation angle of the cam 21A may be increased or reduced in accordance with the lift amount Lb by means of the motor control apparatus 40.

Figure 20:
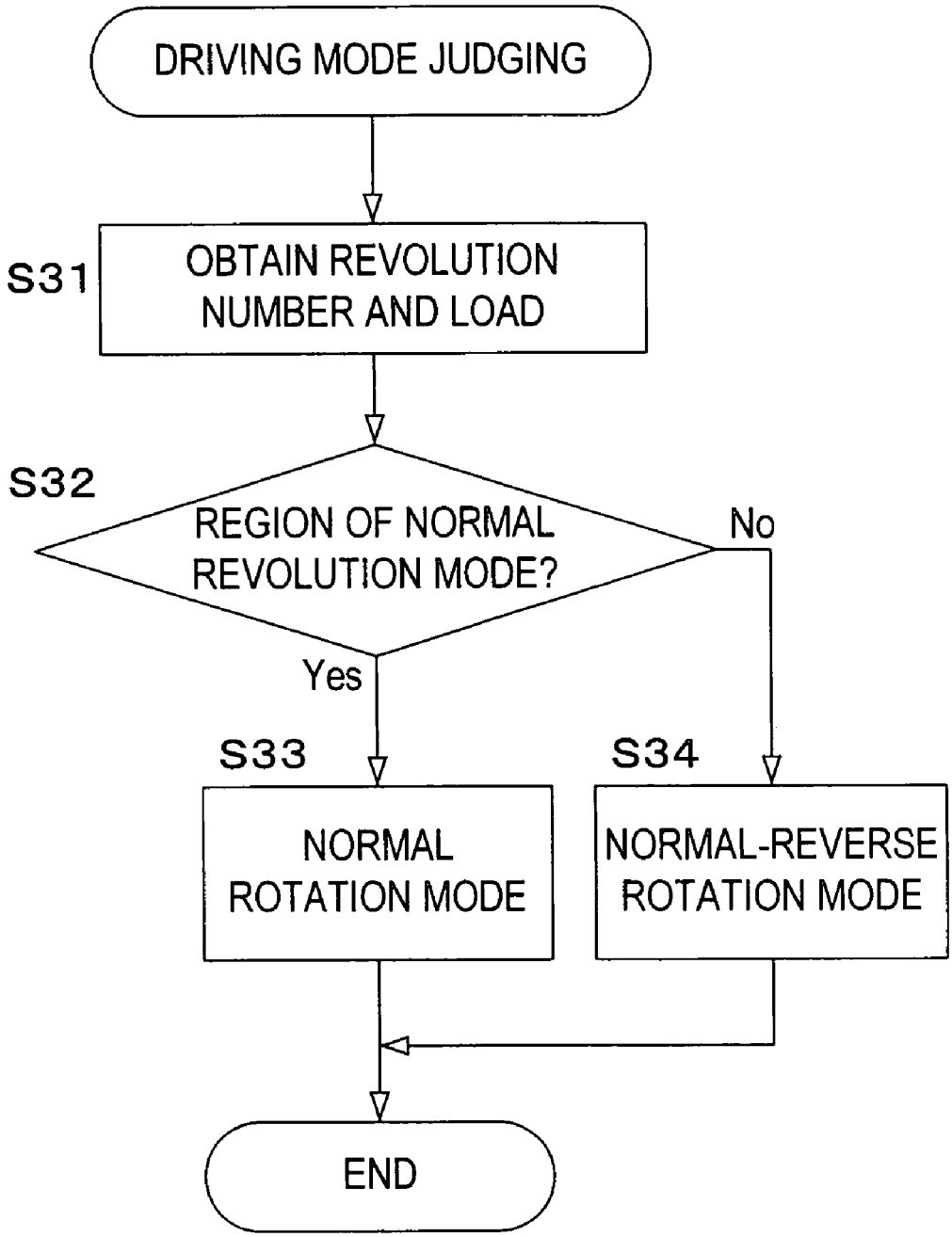
FIG. 20 shows a driving mode judging routine which is executed by the control apparatus for setting the driving mode.

FIG. 20 shows a driving mode judging routine which is repeatedly executed periodically during driving of the internal combustion engine 1 to switch the driving mode of the motor 12 by means of the motor control apparatus 40. If the motor control apparatus 40 executes the driving mode judging routine, the motor control apparatus 40 functions as a lift amount control device and a mode switching device.

In the driving mode judging routine shown in FIG. 20, the motor control apparatus 40 obtains the revolution number and a load of the internal combustion engine 1 in step S31.

In step S32, the motor control apparatus 40 judges whether the current operation state of the internal combustion engine 1 is in a region where the normal rotation mode should be selected in accordance with the conditions shown in FIG. 18. The normal rotation mode or normal-reverse rotation mode is selected in accordance with the result of the judgment (step S33 or S34) and then, the driving mode judging routine is completed.

In the judgment of the driving mode, parameters for judging the driving mode are not limited to the revolution number and the load of the internal combustion engine 1, and various parameters having correlation with the operation state of the internal combustion engine 1 may be referred to. The switching conditions between the normal rotation mode and the normal-reverse rotation mode are not limited to those shown in FIG. 18, and the condition may appropriately be changed. The feedforward control in the first and second embodiments can be used for controlling the output torque of the motor 12 in the normal rotation mode.

[Fourth Embodiment]

Next, a fourth embodiment of the present invention will be explained. In this embodiment, the motor control apparatus 40 executes a cleaning control routine shown in FIG. 21 during a predetermined time period of stop of the internal combustion engine 1, so that the motor control apparatus 40 functions as a valve rotation executing device. The mechanical structures of the valve-driving apparatuses 11A and 11B are the same as those in the first embodiment.

Figure 21:
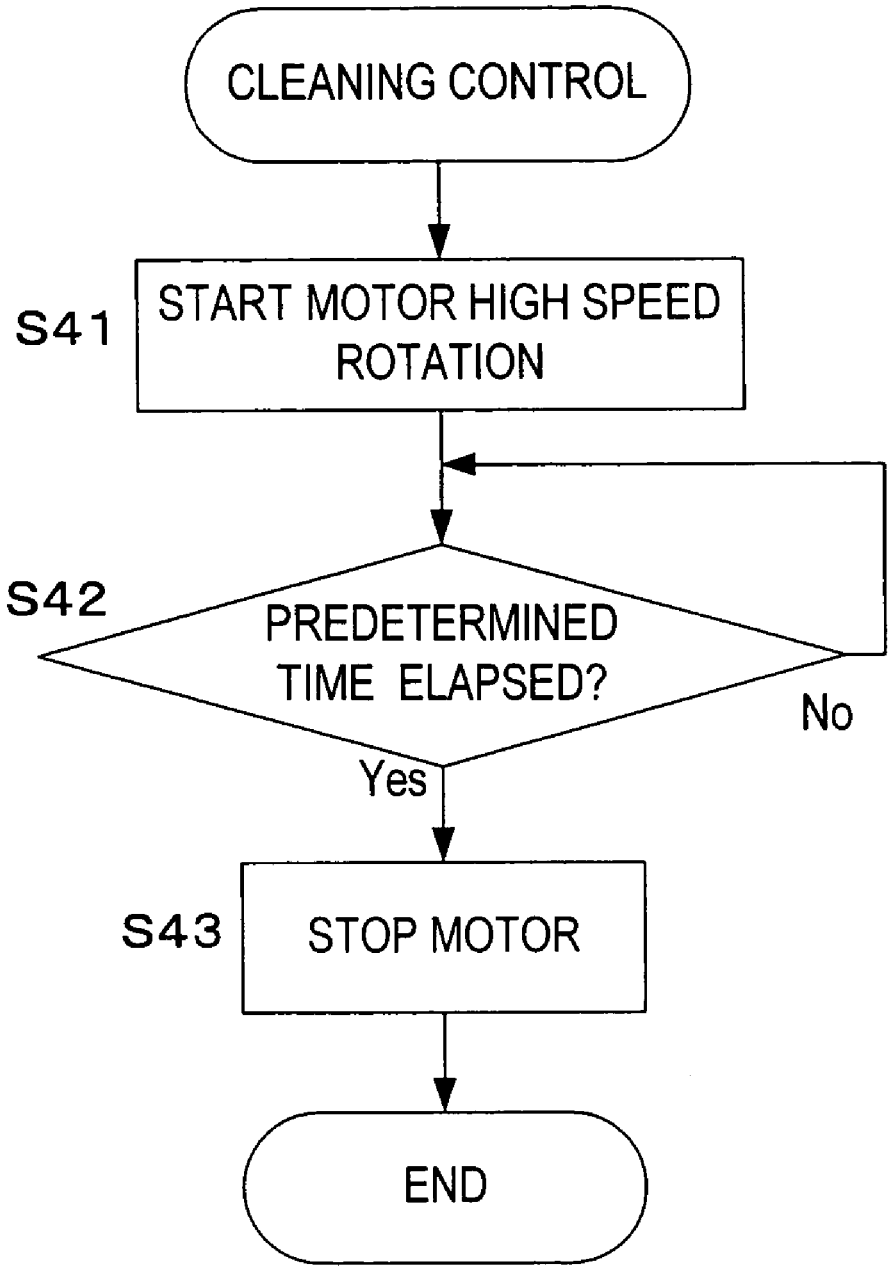
FIG. 21 is a flowchart showing procedure of a cleaning control routine which is executed by the control apparatus for executing the cleaning operation of the intake valve or exhaust valve.

In the cleaning control routine in FIG. 21, the motor control apparatus 40 starts rotating the motor 12 at high speed in step S41, and judges whether a predetermined time is elapsed after the motor 12 starts rotating in step S42. If the predetermined time is elapsed, the procedure proceeds to step S43, where the motor 12 is stopped.

Figure 22:
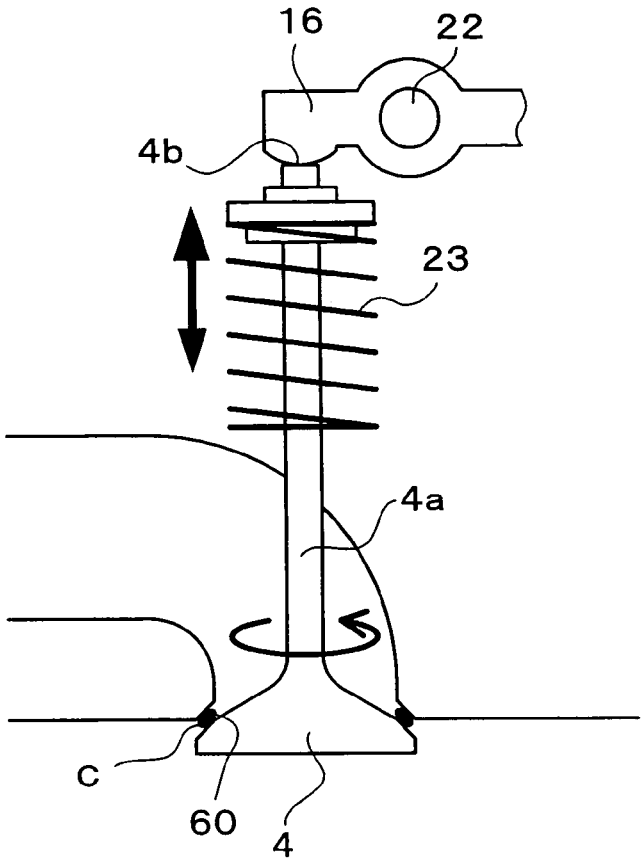
FIG. 22 shows the cleaning operation while operating the intake valve at high speed.
Figure 23A:
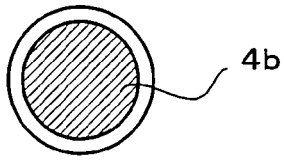
FIGS. 23A and 23B show a friction wear state of an upper end of a stem in comparison, where
Figure 23B:
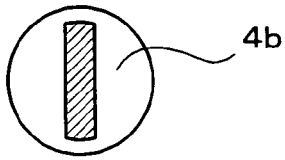

If the motor 12 is rotated at high speed during the stop of the internal combustion engine 1 in this manner, the intake valve 4 is opened and closed at high speed as shown in FIG. 22, a load of the valve spring 23 against the intake valve 4 is reduced by surging phenomenon of the valve spring 23, and the intake valve 4 rotates around an axis of a stem 4*a*. With this, carbon adhered between the intake valve 4 and a valve seat 60 is removed. As the intake valve 4 rotates, a contact portion of the stem upper end 4*b* with respect to the rocker arm 16 is deviated in the circumferential direction. Therefore, the stem upper end 4*b* is worn substantially uniformly in the circumferential direction as shown with a hatching portion in FIG. 23A. If the stem 4*a* is not rotated, only the specific portion of the stem upper end 4*b* comes into contact with the rocker arm 16, and a deviated wear is generated in the stem upper portion 4*b* as shown with a hatching portion in FIG. 23B. Although the cleaning control routine for the intake valve 4 is explained above, the same cleaning control routine shown in FIG. 21 is carried out also for the exhaust valve 5.

The cleaning control routine in FIG. 21 is preferably carried out when an ignition key is pulled out and it is expected that the internal combustion engine 1 is stopped for a long term. It is unnecessary to execute the cleaning control routine shown in FIG. 21 whenever the internal combustion engine 1 is stopped, and the executing timing of the routine may be determined in accordance with an adhering state of carbon to the intake valve 4 and exhaust valve 5 or a proceeding state of wear of the stem of the intake valve 4 or exhaust valve 5.

As explained above, according to the valve-driving system of the present invention, since the plurality of valve-driving apparatuses are provided, it is possible to provide the intake valves or exhaust valves of the plurality of cylinders with appropriate operation characteristics in accordance with the operation state of the internal combustion engine. Especially when at least one of the operation angle, lift characteristics and the maximum lift amount of the intake valve or exhaust valve is changed by controlling the operation of the electric motor, it is possible to more flexibly change the operation of the intake valve or exhaust valve as compared with the conventional valve-driving apparatus in which only the opening and closing timing is changed.

What is claimed is:

1. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the motor control device sets a control amount of the electric motor while taking into account a variation of friction torque which acts on a rotation of the cam.

2. The valve-driving system according to claim 1, wherein the motor control device estimates variation of the number of revolutions of the internal combustion engine based on a variation in the operation state of the internal combustion engine, and sets a control amount of the electric motor while taking the result of the estimation into account.

3. The valve-driving system according to claim 1, wherein a motor rotation position detecting device, which detects a rotation position of the electric motor, is added to the electric motor, and the motor control device includes a cam position specifying device which specifies a rotation position of the cam based on the detection result of the rotation position of the electric motor.

4. The valve-driving system according to claim 3, wherein when a speed reducing ratio between the electric motor and the cam is defined as N:M (wherein, N>M, and N and M are integers having no common divisors except 1), N is set to 6 or lower.

5. The valve-driving system according to claim 1, wherein the motor control device determines parameters representing operation details of the valve to be driven in accordance with an operation state of the internal combustion engine, obtains estimated values of the friction torque based on the determined parameters, and sets a driving current of the electric motor in accordance with the estimated value of the friction torque.

6. The valve-driving system according to claim 5, wherein the motor control device obtains the estimated value of the friction torque by summing up a base friction torque corresponding to basic rotation resistance which is applied to the electric motor when the cam is rotated and a variation component of the cam friction torque generated by a valve spring which urges the valve.

7. The valve-driving system according to claim 5, further comprising an air fuel ratio sensor for measuring an air fuel ratio in the internal combustion engine, wherein the motor control device corrects at least one of the parameters based on a difference between an air fuel ratio measured by an air fuel ratio sensor and a target air fuel ratio which is set in accordance with the operation state of the internal combustion engine, and obtains the estimated value of the friction torque so as to reflect a correction of at least one of the parameters, thereby attempting to cancel a deviation between the measured air fuel ratio and the target air fuel ratio.

8. The valve-driving system according to claim 7, wherein the motor control device determines whether or not the electric motor is abnormal based on a difference between a driving current obtained by reflecting the correction of at least one of the parameters and a standard driving current which can be obtained without taking the correction of at least one of the parameters into account.

9. The valve-driving system according to claim 7, wherein the motor control device determines whether or not the valve driving apparatus is abnormal based on a fluctuation amount of the parameters.

10. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the motor control device sets a control amount of the electric motor while taking into account a control state concerning intake or exhaust characteristics of the internal combustion engine and corrects the control amount of the motor such that an air fuel ratio is controlled to a predetermined target value while taking, into account, a control state concerning the air fuel ratio as a characteristic of the internal combustion engine.

11. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the valve-driving system further comprises an abnormality judging device which judges whether the valve-driving system is abnormal based on a correction amount with respect to a control amount of the electric motor, the correction amount being provided by a consideration of a control state concerning intake or exhaust characteristics of the internal combustion engine.

12. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and when a friction torque acting on a rotation of the cam assumes a negative value, the electric motor is capable of being driven by a rotation motion of the cam to generate electricity.

13. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the motor control device includes an initializing device which makes the electric motor rotate in accordance with a predetermined condition when the internal combustion engine is in a predetermined state, and which grasps a rotation position of the cam based on a variation in a driving state of the electric motor which appears in connection with a variation in a friction torque of the cam while rotating.

14. The valve-driving system according to claim 13, wherein the initializing device rotates the electric motor when the internal combustion engine is stopped to grasp the rotation position of the cam, and makes a storing device, which can store information also during a stop time period of the internal combustion engine, store therein information indicative of the grasped rotation position of the cam, and the motor control device specifies the rotation position of the cam based on the information stored in the storing device when the internal combustion engine is started next time, and starts controlling the electric motor.

15. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the motor control device includes a valve rotation executing device which drives the electric motor such that the valve rotates around an axial direction thereof in a predetermined time period during stoppage of the internal combustion engine.

16. A valve-driving system which is applied to an internal combustion engine having a plurality of cylinders for driving an intake or exhaust valve provided in each cylinder, comprising:

a plurality of valve-driving apparatuses, each of which is provided for at least each one of the intake valve and the exhaust valve, each valve-driving apparatus comprising an electric motor as a driving source for generating rotation motion and a power transmission mechanism provided with a transmitting section for transmitting the rotation motion generated by the electrical motor and a converting section for converting the rotation motion transmitted from the transmitting section into opening and closing motion of the valve to be driven; and a motor control device which controls operations of electric motors of the respective valve-driving apparatuses in accordance with an operation state of the internal combustion engine, wherein:

the converting section of the power transmission mechanism converts the rotation motion generated by the electric motor into the opening and closing motion utilizing a cam, and the motor control device includes a mode switching device which switches driving modes of the electric motor between a normal rotation mode in which the electric motor is driven only in a normal direction to open and close the valve and a normal-reverse rotation mode in which the electric motor is normally or reversely rotated in accordance with the operation state of the internal combustion engine.

17. The valve-driving system according to claim 16, wherein the motor control device includes a lift amount control device which normally and reversely drives the electric motor in the normal-reverse rotation mode such that a lift amount of the valve is limited to a predetermined value which is smaller than a maximum lift amount which can be obtained when the cam is rotated through one revolution in the normal rotation mode.

* * * * *